US011686069B2

(12) United States Patent
Yamamoto

(10) Patent No.: US 11,686,069 B2
(45) Date of Patent: Jun. 27, 2023

(54) SHOVEL

(71) Applicant: SUMITOMO CONSTRUCTION MACHINERY CO., LTD., Tokyo (JP)

(72) Inventor: Takashi Yamamoto, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 425 days.

(21) Appl. No.: 16/846,886

(22) Filed: Apr. 13, 2020

(65) Prior Publication Data

US 2020/0240114 A1 Jul. 30, 2020

Related U.S. Application Data

(63) Continuation of application No. PCT/JP2018/037863, filed on Oct. 11, 2018.

(30) Foreign Application Priority Data

Oct. 20, 2017 (JP) ..... JP2017-203882

(51) Int. Cl.

| | |
|---|---|
| ***E02F 9/22*** | (2006.01) |
| ***E02F 9/20*** | (2006.01) |
| *E02F 3/32* | (2006.01) |
| *E02F 3/43* | (2006.01) |

(52) U.S. Cl.

CPC ..... *E02F 9/2225* (2013.01); *E02F 9/2004* (2013.01); *E02F 9/2271* (2013.01); *E02F 9/2285* (2013.01); *E02F 3/32* (2013.01); *E02F 3/435* (2013.01); *E02F 9/2292* (2013.01); *E02F 9/2296* (2013.01)

(58) Field of Classification Search

CPC ..... E02F 9/2207; F15B 2211/8616; F15B 21/008; F15B 2211/8613; B66C 13/066

See application file for complete search history.

(56) References Cited

U.S. PATENT DOCUMENTS

| | | | | |
|---|---|---|---|---|
| 7,278,262 | B2 * | 10/2007 | Moon | F15B 21/087 60/426 |
| 10,344,783 | B2 * | 7/2019 | Wang | E04G 21/0454 |
| 2005/0177292 | A1 * | 8/2005 | Okamura | E02F 9/2207 701/50 |

(Continued)

FOREIGN PATENT DOCUMENTS

| | | |
|---|---|---|
| EP | 0844338 | 5/1998 |
| EP | 1813821 | 8/2007 |

(Continued)

OTHER PUBLICATIONS

International Search Report for PCT/JP2018/037863 dated Jan. 15, 2019.

*Primary Examiner* — Abiy Teka
(74) *Attorney, Agent, or Firm* — Ipusa, PLLC

(57) ABSTRACT

A shovel includes a hydraulic actuator, an operating apparatus used to operate the hydraulic actuator, an obtaining device configured to obtain information concerning the vibration of the body of a shovel, and a hardware processor. The hardware processor is configured to perform such control as to reduce the responsiveness of the hydraulic actuator to the operation of the operating apparatus when the body of the shovel is vibrating or the vibration is likely to occur in the body of the shovel, based on the output of the obtaining device.

18 Claims, 20 Drawing Sheets

(56) References Cited

U.S. PATENT DOCUMENTS

| | | | | |
|---|---|---|---|---|
| 2007/0130933 | A1* | 6/2007 | Yoshino | F15B 21/008 60/469 |
| 2014/0088839 | A1* | 3/2014 | Magaki | E02F 9/2033 701/50 |

FOREIGN PATENT DOCUMENTS

| | | | |
|---|---|---|---|
| EP | 2644785 | | 10/2013 |
| JP | 2000-291075 | | 10/2000 |
| JP | 20000291075 | * | 10/2000 |
| JP | 2006-125827 | | 5/2006 |
| JP | 2007-051781 | | 3/2007 |
| WO | 2015/155878 | | 10/2015 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2018/037863, filed on Oct. 11, 2018 and designating the U.S., which claims priority to Japanese patent application No. 2017-203882, filed on Oct. 20, 2017. The entire contents of the foregoing applications are incorporated herein by reference.

BACKGROUND

Technical Field

The present disclosure relates to shovels.

Description of Related Art

A lever operation system with such a circuit structure as to make it possible to reduce the generation of shock by restricting, in response to a lever input, a pilot input to a control valve that controls the operation of a hydraulic actuator even when a lever is rapidly operated by a shovel operator has been proposed.

SUMMARY

According to an aspect of the present invention, a shovel includes a hydraulic actuator, an operating apparatus used to operate the hydraulic actuator, an obtaining device configured to obtain information concerning the vibration of the body of a shovel, and a hardware processor. The hardware processor is configured to perform such control as to reduce the responsiveness of the hydraulic actuator to the operation of the operating apparatus when the body of the shovel is vibrating or the vibration is likely to occur in the body of the shovel, based on the output of the obtaining device.

DETAILED DESCRIPTION

Figure 1:
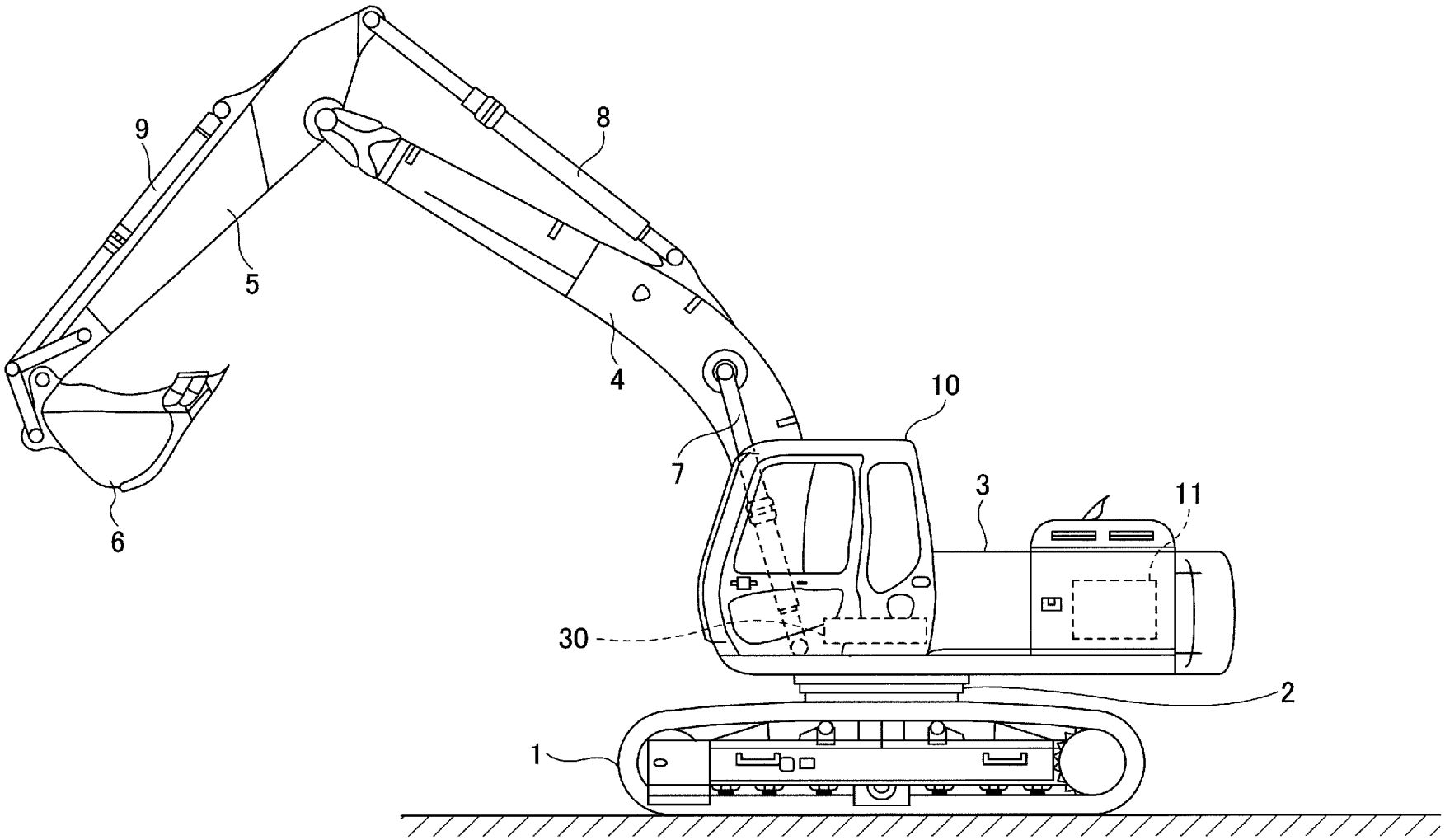
FIG. 1 is a side view of a shovel (excavator) according to an embodiment.

There is a trade-off, however, between the responsiveness of a hydraulic actuator to a lever operation and reduction in shock caused by a rapid lever operation, and a value to which a pilot pressure is reduced in response to the rapid operation has to be so set as to also satisfy a normally required level of responsiveness. That is, it is difficult to unrestrictedly reduce a pilot pressure.

Furthermore, when an operator operates a shovel where the shovel is on unstable ground, for example, on an obstacle such as wood or a stone, even a small lever operation may cause the shovel to vibrate. This vibration also shakes the operator. Therefore, the phenomenon that the operator inputs an unintended operation through an operating lever (so-called hand hunting) is caused, so that the vibration of the shovel body (that is, the body of the shovel including the lower traveling body and the upper turning body) may be further amplified by the effect of the hand hunting. The related-art technique cannot prevent such amplification of vibration at the time of occurrence of hand hunting.

According to an aspect of the present invention, a shovel that can control the amplification of the vibration of the body of the shovel even when hand hunting occurs is provided.

Embodiments are described below with reference to the accompanying drawings. To facilitate an understanding of the description, in the drawings, identical components are referred to using the same reference numeral as much as possible, and duplicate description thereof is omitted.

An embodiment is described with reference to FIGS. 1 through 6.

[Overall Configuration of Shovel]

First, an overall configuration of a shovel according to the embodiment is described with reference to FIG. 1. FIG. 1 is a side view of the shovel (excavator) according to the embodiment.

As illustrated in FIG. 1, an upper turning body 3 is turnably mounted on a lower traveling body 1 of the shovel via a turning mechanism 2. A boom 4 is attached to the upper turning body 3. An arm 5 is attached to the distal end of the boom 4, and a bucket 6 serving as an end attachment is attached to the distal end of the arm 5. The boom 4, the arm 5, and the bucket 6 constitute an excavation attachment that is an example of an attachment, and are hydraulically driven by a boom cylinder 7, an arm cylinder 8, and a bucket cylinder 9, respectively. A cabin 10 that is a cab is provided and a power source such as an engine 11 is mounted on the upper turning body 3.

A controller 30 is installed in the cabin 10. The controller 30 is a control device that operates as a main control unit to control the driving of the shovel. According to this embodiment, the controller 30 is composed of a computer including a CPU, a RAM, and a ROM. For example, in the following, various functions of the controller 30 shown as an acceleration and deceleration characteristic control part 300 are implemented by, for example, the CPU executing programs stored in the ROM.

[Configuration of Drive System]

Figure 2:
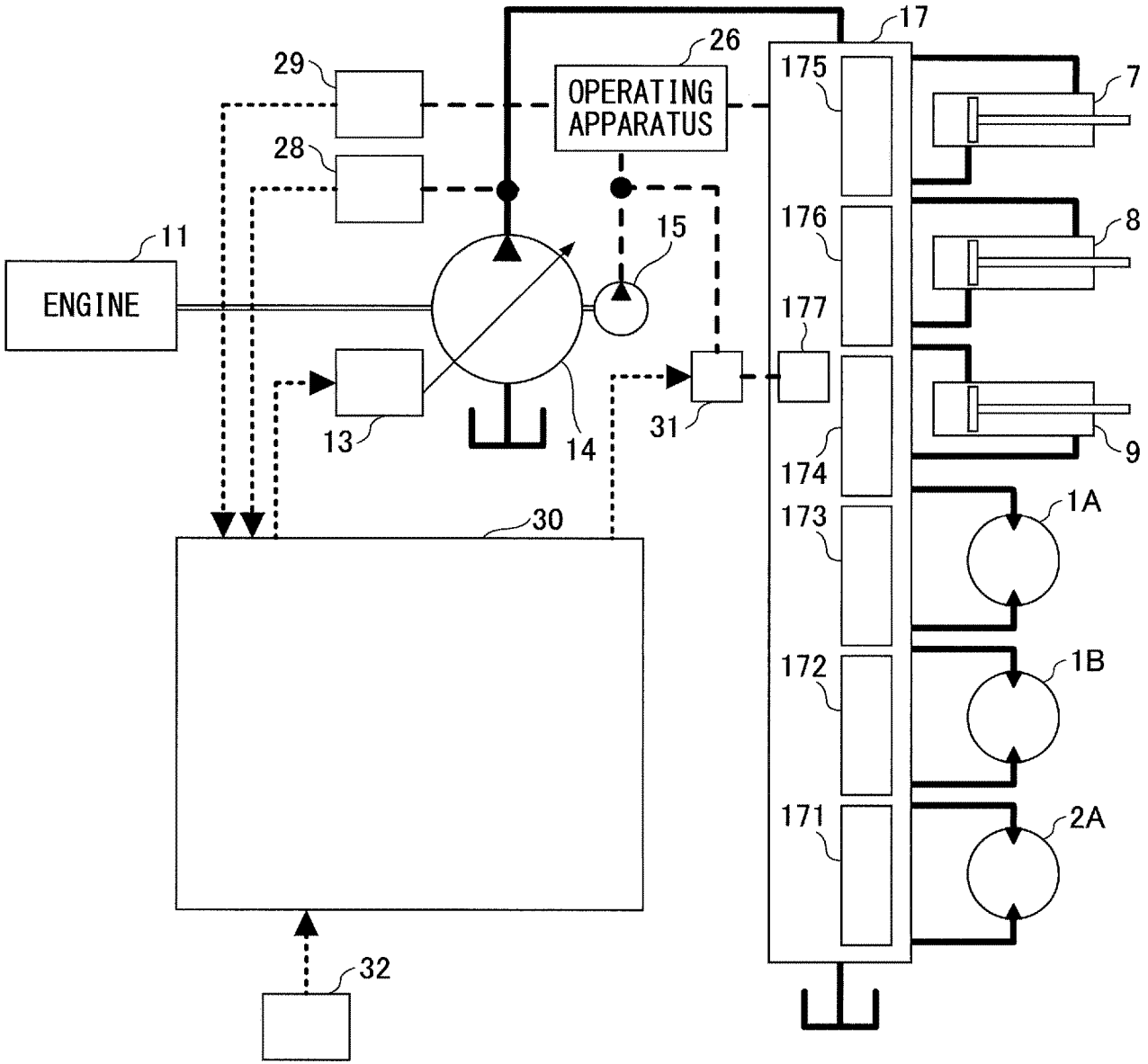
FIG. 2 is a block diagram illustrating an example configuration of the drive system of the shovel of FIG. 1.

Next, a configuration of the drive system of the shovel of FIG. 1 is described with reference to FIG. 2. FIG. 2 is a block diagram illustrating an example configuration of the drive system of the shovel of FIG. 1. In FIG. 2, a mechanical power system, a high-pressure hydraulic line, a pilot line, and an electric control system are indicated by a double line, a thick solid line, a dashed line, and a dotted line, respectively.

As illustrated in FIG. 2, the drive system of the shovel mainly includes the engine 11, a regulator 13, a main pump 14, a pilot pump 15, a control valve 17, an operating apparatus 26, a discharge pressure sensor 28, an operating pressure sensor 29, the controller 30, a proportional valve 31, and a body tilt sensor 32.

The engine 11 is a drive source of the shovel. According to this embodiment, the engine 11 is, for example, a diesel engine that so operates as to maintain a predetermined rotational speed. Furthermore, the output shaft of the engine 11 is coupled to the input shafts of the main pump 14 and the pilot pump 15.

The main pump 14 supplies hydraulic oil to the control valve 17 via a high-pressure hydraulic line. According to this embodiment, the main pump 14 is a swash plate variable displacement hydraulic pump.

The regulator 13 controls the discharge quantity of the main pump 14. According to this embodiment, the regulator 13 controls the discharge quantity of the main pump 14 by adjusting the tilt angle of the swash plate of the main pump 14 in response to a control command from the controller 30.

The pilot pump 15 supplies hydraulic oil to various hydraulic control apparatuses including the operating apparatus 26 and the proportional valve 31 via a pilot line. According to this embodiment, the pilot pump 15 is a fixed displacement hydraulic pump.

The control valve 17 is a hydraulic control device that controls a hydraulic system in the shovel. The control valve 17 includes control valves 171 through 176 and a bleed valve 177. The control valve 17 can selectively supply hydraulic oil discharged by the main pump 14 to one or more hydraulic actuators through the control valves 171 through 176. The control valves 171 through 176 controls the flow rate of hydraulic oil flowing from the main pump 14 to hydraulic actuators and the flow rate of hydraulic oil flowing from hydraulic actuators to a hydraulic oil tank. The hydraulic actuators include the boom cylinder 7, the arm cylinder 8, the bucket cylinder 9, a left side traveling hydraulic motor 1A, a right side traveling hydraulic motor 1B, and a turning hydraulic motor 2A. The bleed valve 177 controls the flow rate of a portion of hydraulic oil discharged by the main pump 14 which portion flows to the hydraulic oil tank through no hydraulic actuators (hereinafter, "bleed flow rate"). The bleed valve 177 may be installed outside the control valve 17.

The operating apparatus 26 is an apparatus that an operator uses to operate hydraulic actuators. According to this embodiment, the operating apparatus 26 supplies hydraulic oil discharged by the pilot pump 15 to the pilot ports of control valves corresponding to hydraulic actuators through a pilot line. The pressure of hydraulic oil supplied to each pilot port (pilot pressure) is a pressure commensurate with the direction of operation and the amount of operation of a lever or pedal (not depicted) of the operating apparatus 26 for a corresponding hydraulic actuator.

The discharge pressure sensor 28 detects the discharge pressure of the main pump 14. According to this embodiment, the discharge pressure sensor 28 outputs the detected value to the controller 30.

The operating pressure sensor 29 detects the details of the operator's operation using the operating apparatus 26. According to this embodiment, the operating pressure sensor 29 detects the direction of operation and the amount of operation of a lever or pedal of the operating apparatus 26 for a corresponding hydraulic actuator in the form of pressure (operating pressure), and outputs the detected value to the controller 30. The details of the operation of the operating apparatus 26 may be detected using a sensor other than an operating pressure sensor.

The proportional valve 31 operates in response to a control command output by the controller 30. According to this embodiment, the proportional valve 31 is a solenoid valve that adjusts a secondary pressure introduced from the pilot pump 15 to the pilot port of the bleed valve 177 in the control valve 17, in response to an electric current command output by the controller 30. For example, the proportional valve 31 operates such that the secondary pressure introduced to the pilot port of the bleed valve 177 increases as the electric current command increases.

The body tilt sensor 32 detects the inclination angle of the shovel body (that is, the body including the lower traveling body and the upper turning body) (body inclination angle). The body tilt sensor 32 is provided on, for example, the upper turning body 3 and outputs the inclination angle of the upper turning body 3 to the controller 30 as the body inclination angle.

[Configuration of Hydraulic Circuit]

Figure 3:
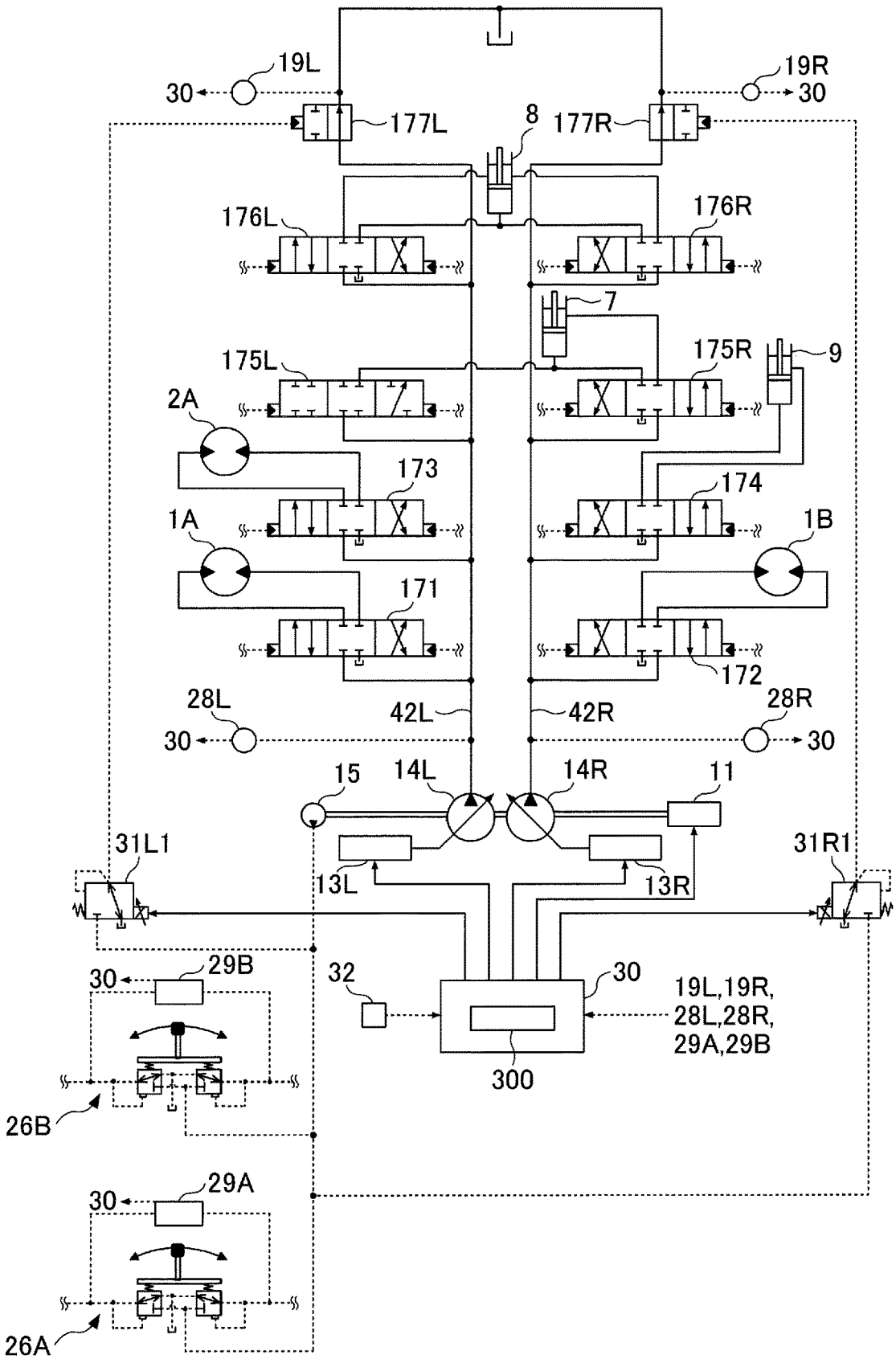
FIG. 3 is a schematic diagram illustrating an example configuration of a hydraulic circuit installed in the shovel of FIG. 1.

Next, an example configuration of a hydraulic circuit installed in the shovel is described with reference to FIG. 3. FIG. 3 is a schematic diagram illustrating an example configuration of the hydraulic circuit installed in the shovel of FIG. 1. Like FIG. 2, FIG. 3 indicates the mechanical power system, the hydraulic oil line, the pilot line, and the electric control system by a double line, a thick solid line, a dashed line, and a dotted line, respectively.

The hydraulic circuit of FIG. 3 circulates hydraulic oil from main pumps 14L and 14R driven by the engine 11 to the hydraulic oil tank via conduits 42L and 42R. The main pumps 14L and 14R correspond to the main pump 14 of FIG. 2.

The conduit 42L is a high-pressure hydraulic line that connects the control valves 171 and 173 and control valves 175L and 176L placed in the control valve 17 in parallel between the main pump 14L and the hydraulic oil tank. The conduit 42R is a high-pressure hydraulic line that connects the control valves 172 and 174 and control valves 175R and 176R placed in the control valve 17 in parallel between the main pump 14R and the hydraulic oil tank.

The control valve 171 is a spool valve that switches the flow of hydraulic oil in order to supply hydraulic oil discharged by the main pump 14L to the left side traveling hydraulic motor 1A and to discharge hydraulic oil discharged by the left side traveling hydraulic motor 1A to the hydraulic oil tank.

The control valve 172 is a spool valve that switches the flow of hydraulic oil in order to supply hydraulic oil discharged by the main pump 14R to the right side traveling hydraulic motor 1B and to discharge hydraulic oil discharged by the right side traveling hydraulic motor 1B to the hydraulic oil tank.

The control valve 173 is a spool valve that switches the flow of hydraulic oil in order to supply hydraulic oil discharged by the main pump 14L to the turning hydraulic motor 2A and to discharge hydraulic oil discharged by the turning hydraulic motor 2A to the hydraulic oil tank.

The control valve 174 is a spool valve for supplying hydraulic oil discharged by the main pump 14R to the bucket cylinder 9 and to discharge hydraulic oil in the bucket cylinder 9 to the hydraulic oil tank.

The control valves 175L and 175R are spool valves that switch the flow of hydraulic oil in order to supply hydraulic oil discharged by the main pumps 14L and 14R to the boom cylinder 7 and to discharge hydraulic oil in the boom cylinder 7 to the hydraulic oil tank.

The control valves 176L and 176R are spool valves that switch the flow of hydraulic oil in order to supply hydraulic oil discharged by the main pumps 14L and 14R to the arm cylinder 8 and to discharge hydraulic oil in the arm cylinder 8 to the hydraulic oil tank.

A bleed valve 177L is a spool valve that controls the bleed flow rate with respect to hydraulic oil discharged by the main pump 14L. A bleed valve 177R is a spool valve that controls the bleed flow rate with respect to hydraulic oil discharged by the main pump 14R. The bleed valves 177L and 177R correspond to the bleed valve 177 of FIG. 2.

The bleed valves 177L and 177R have a first valve position of a minimum opening area (an opening degree of 0%) and a second valve position of a maximum opening area (an opening degree of 100%), for example. The bleed valves 177L and 177R can steplessly move between the first valve position and the second valve position.

Regulators 13L and 13R control the discharge quantity of the main pumps 14L and 14R by adjusting the swash plate tilt angle of the main pumps 14L and 14R. The regulators 13L and 13R correspond to the regulator 13 of FIG. 2. For example, the controller 30 reduces the discharge quantity by adjusting the swash plate tilt angle of the main pumps 14L and 14R with the regulators 13L and 13R according as the discharge pressure of the main pumps 14L and 14R increases. This is for preventing the absorbed power of the main pump 14 expressed by the product of the discharge pressure and the discharge quantity from exceeding the output power of the engine 11.

An arm operating lever 26A, which is an example of the operating apparatus 26, is used to operate the arm 5. The arm operating lever 26A-uses hydraulic oil discharged by the pilot pump 15 to introduce a control pressure commensurate with the amount of lever operation to pilot ports of the control valves 176L and 176R. Specifically, when operated in an arm closing direction, the arm operating lever 26A introduces hydraulic oil to the right side pilot port of the control valve 176L and introduces hydraulic oil to the left side pilot port of the control valve 176R. Furthermore, when operated in an arm opening direction, the arm operating lever 26A introduces hydraulic oil to the left side pilot port of the control valve 176L and introduces hydraulic oil to the right side pilot port of the control valve 176R.

A boom operating lever 26B, which is an example of the operating apparatus 26, is used to operate the boom 4. The boom operating lever 26B uses hydraulic oil discharged by the pilot pump 15 to introduce a control pressure commensurate with the amount of lever operation to pilot ports of the control valve 175L and 175R. Specifically, when operated in a boom raising direction, the boom operating lever 26B introduces hydraulic oil to the right side pilot port of the control valve 175L and introduces hydraulic oil to the left side pilot port of the control valve 175R. Furthermore, when operated in a boom lowering direction, the boom operating lever 26B introduces hydraulic oil to the left side pilot port of the control valve 175L and introduces hydraulic oil to the right side pilot port of the control valve 175R.

Discharge pressure sensors 28L and 28R, which are examples of the discharge pressure sensor 28, detect the discharge pressure of the main pumps 14L and 14R, and output the detected value to the controller 30.

Operating pressure sensors 29A and 29B, which are examples of the operating pressure sensor 29, detect the details of the operator's operation on the arm operating lever 26A and the boom operating lever 26B in the form of pressure, and output the detected value to the controller 30. Examples of the details of operation include the direction of lever operation and the amount of lever operation (the angle of lever operation).

Right and left travel levers (or pedals), a bucket operating lever, and a turning operating lever (none of which is depicted) are operating apparatuses for performing operations for causing the lower traveling body 1 to travel, causing the bucket 6 to open and close, and causing the upper turning body 3 to turn, respectively. Like the arm operating lever 26A and the boom operating lever 26B, these operating apparatuses each introduce a control pressure commensurate with the amount of lever operation (or the amount of pedal operation) to the right or left pilot port of a control valve for a corresponding hydraulic actuator, using hydraulic oil discharged by the pilot pump 15. The details of the operator's operation on each of these operating apparatuses are detected in the form of pressure by a corresponding operating pressure sensor like the operating pressure sensors 29A and 29B, and the detected value is output to the controller 30.

The controller 30 receives the outputs of the operating pressure sensors 29A and 29B, etc., and outputs a control command to the regulators 13L and 13R to change the discharge quantity of the main pump 14L and 14R on an as-needed basis. Furthermore, the controller 30 outputs an electric current command to proportional valves 31L1, 31L2, 31R1, and 31R2 to change the opening area of the bleed valves 177L and 177R on an as-needed basis.

The proportional valves 31L1 and 31R1 adjust a secondary pressure introduced from the pilot pump 15 to the pilot ports of the bleed valves 177L and 177R in accordance with an electric current command output by the controller 30. The proportional valves 31L1 and 31L2 correspond to the proportional valve 31 of FIG. 2.

The proportional valve 31L1 can adjust the secondary pressure so that the bleed valve 177L can stop at any position between the first valve position and the second valve position. The proportional valve 31R1 can adjust the secondary pressure so that the bleed valve 177R can stop at any position between the first valve position and the second valve position.

[Control of Acceleration and Deceleration Characteristic]

According to shovels, the operability of a shovel for an operator and the efficiency of the operator's shovel work may be improved, the operator's fatigue may be reduced, and the operator's safety may be increased by slowly changing responsiveness to and an acceleration and deceleration characteristic with respect to the operation of a lever (or the operation of a pedal) of the operating apparatus 26 in accordance with work details.

For example, when the body of a shovel is vibrating, this vibration shakes an operator. Therefore, so-called hand hunting to input an unintended operation may be caused, so that the vibration of the shovel body may be further amplified because of the effect of this hand hunting. In this case, responsiveness to and an acceleration and deceleration characteristic with respect to the operation of a lever (or the operation of a pedal) of the operating apparatus 26 are preferably low. Because it is possible to carefully (slowly) move the shovel, it is possible to prevent hydraulic actuators (a boom, an arm, a bucket, etc.) from quickly moving in response to the lever operation.

Therefore, according to this embodiment, the acceleration and deceleration characteristic control part 300 of the controller 30 controls the acceleration and deceleration characteristic of a hydraulic actuator with respect to the operation of a lever (or the operation of a pedal) of the operating apparatus 26, in accordance with the presence or absence of the occurrence of vibration in the shovel body. Specifically, when the vibration of the shovel body is detected, the acceleration and deceleration characteristic control part 300 changes the acceleration and deceleration characteristic of a hydraulic actuator in such a manner as to lower the acceleration and deceleration characteristic of a hydraulic actuator. Accordingly, it is possible to improve the efficiency of the operator's shovel work, reduce the operator's fatigue and increase the operator's safety.

Figure 4:
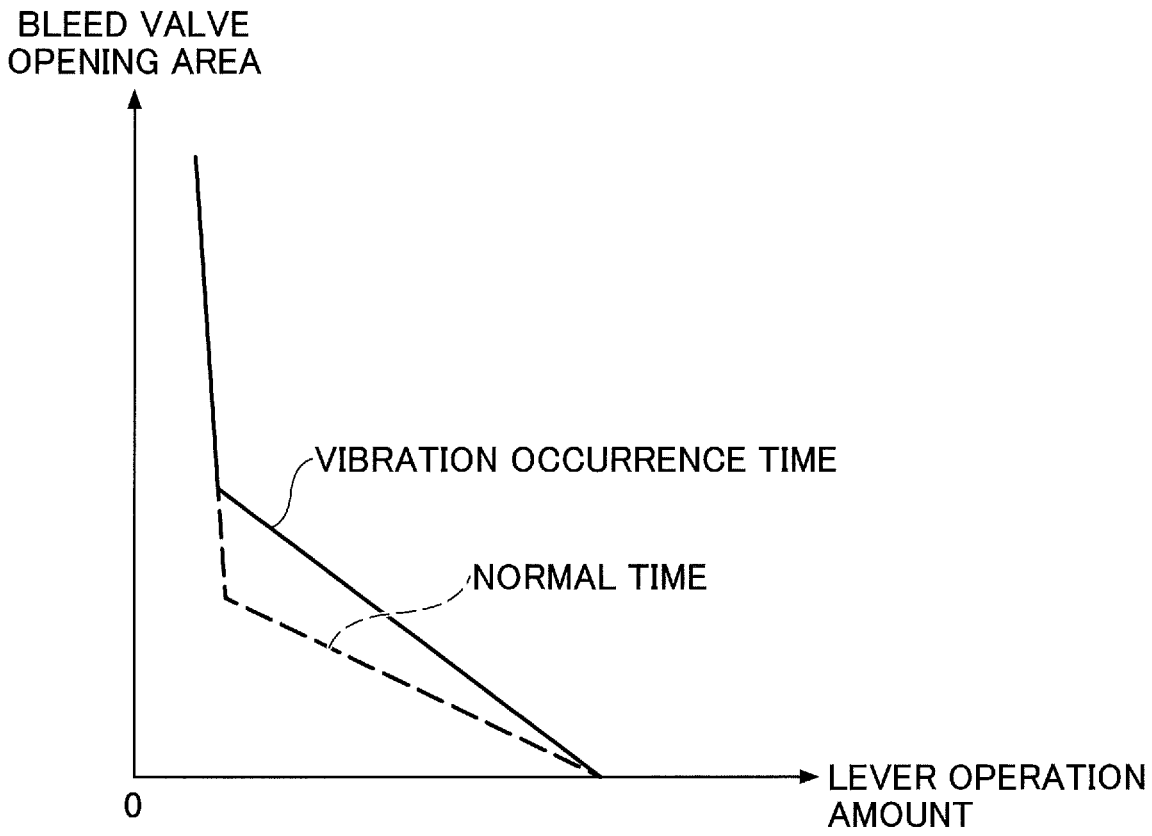
FIG. 4 is a graph illustrating a relationship between the amount of lever operation and a bleed valve opening area according to work modes.

FIG. 4 is a graph illustrating a relationship between the amount of lever operation and the opening area of a bleed valve according to work modes. The relationship between the amount of lever operation and the opening area of a bleed valve (hereinafter referred to as "bleed valve opening characteristic") may be, for example, either stored in a ROM or the like as a reference table or expressed by a predetermined calculating formula.

The acceleration and deceleration characteristic control part 300 controls the opening area of the bleed valve 177 by changing the bleed valve opening characteristic according to the presence or absence of the occurrence of vibration in the shovel body. For example, as illustrated in FIG. 4, on condition that the amount of lever operation remains the same, the acceleration and deceleration characteristic control part 300 causes the opening area of the bleed valve 177 to be larger in the setting of a "vibration occurrence time mode" than in the setting of a "normal time mode," in order to reduce an actuator flow rate by increasing the bleed flow rate. This makes it possible to reduce the responsiveness to the operation of a lever of the operating apparatus 26 to reduce the acceleration and deceleration characteristic.

More specifically, the acceleration and deceleration characteristic control part 300 increases or decreases the opening area of the bleed valve 177 by outputting a control command corresponding to a work mode to the proportional valve 31. For example, when the "vibration occurrence time mode" is selected, the acceleration and deceleration characteristic control part 300 increases the opening area of the bleed valve 177 by reducing the secondary pressure of the proportional valve 31 by reducing an electric current command to the proportional valve 31, compared with when the "normal time mode" is selected. This is for reducing the actuator flow rate by increasing the bleed flow rate.

Figure 5:
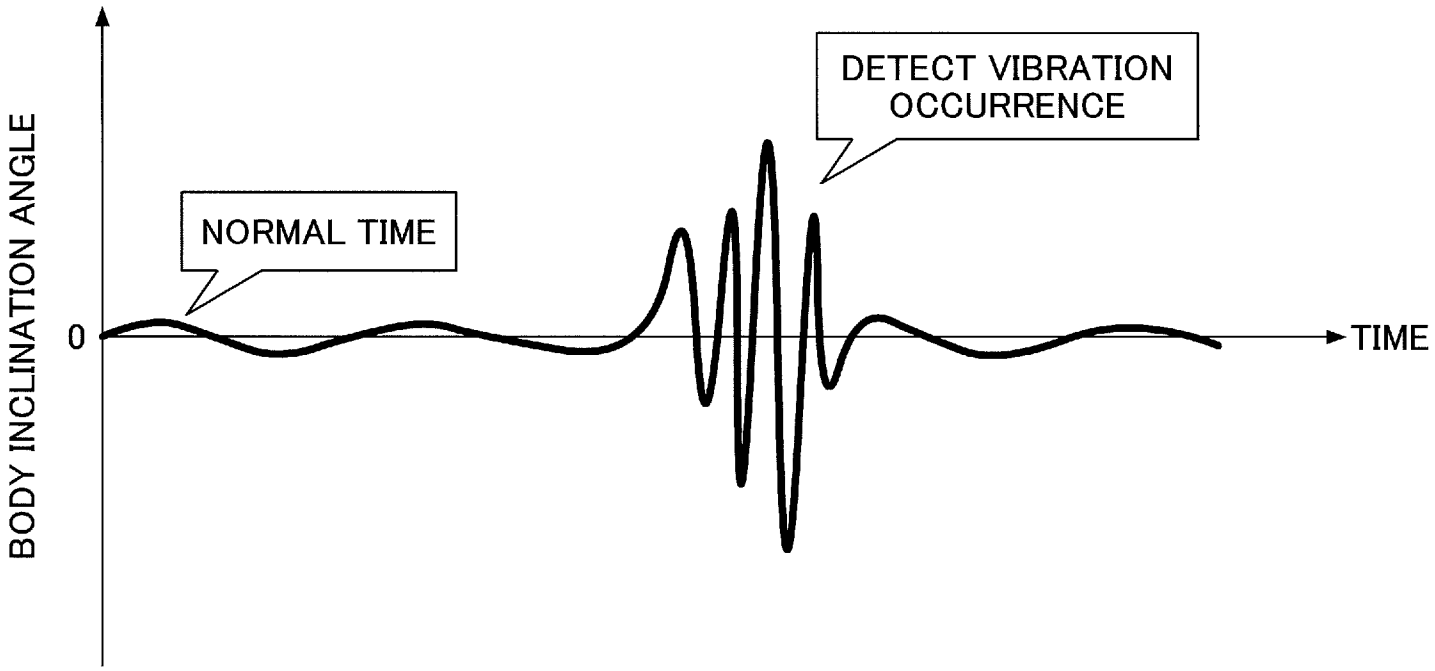
FIG. 5 is a graph illustrating waveform examples of the body inclination angle at a normal time and a vibration occurrence time.

The acceleration and deceleration characteristic control part 300 can detect the presence or absence of the occurrence of vibration in the shovel body based on, for example, the body inclination angle detected by the body tilt sensor 32. FIG. 5 is a graph illustrating waveform examples of the body inclination angle at a normal time and a vibration occurrence time. As illustrated in FIG. 5, the body inclination angle is stable approximately around 0 degrees at the normal time. In contrast, the body inclination angle significantly fluctuates in a positive direction and a negative direction from 0 degrees at the vibration occurrence time. The acceleration and deceleration characteristic control part 300 detects the presence or absence of the occurrence of vibration in the shovel body based on such a difference in the waveform of the body inclination angle between the normal time and the vibration occurrence time.

Figure 6:
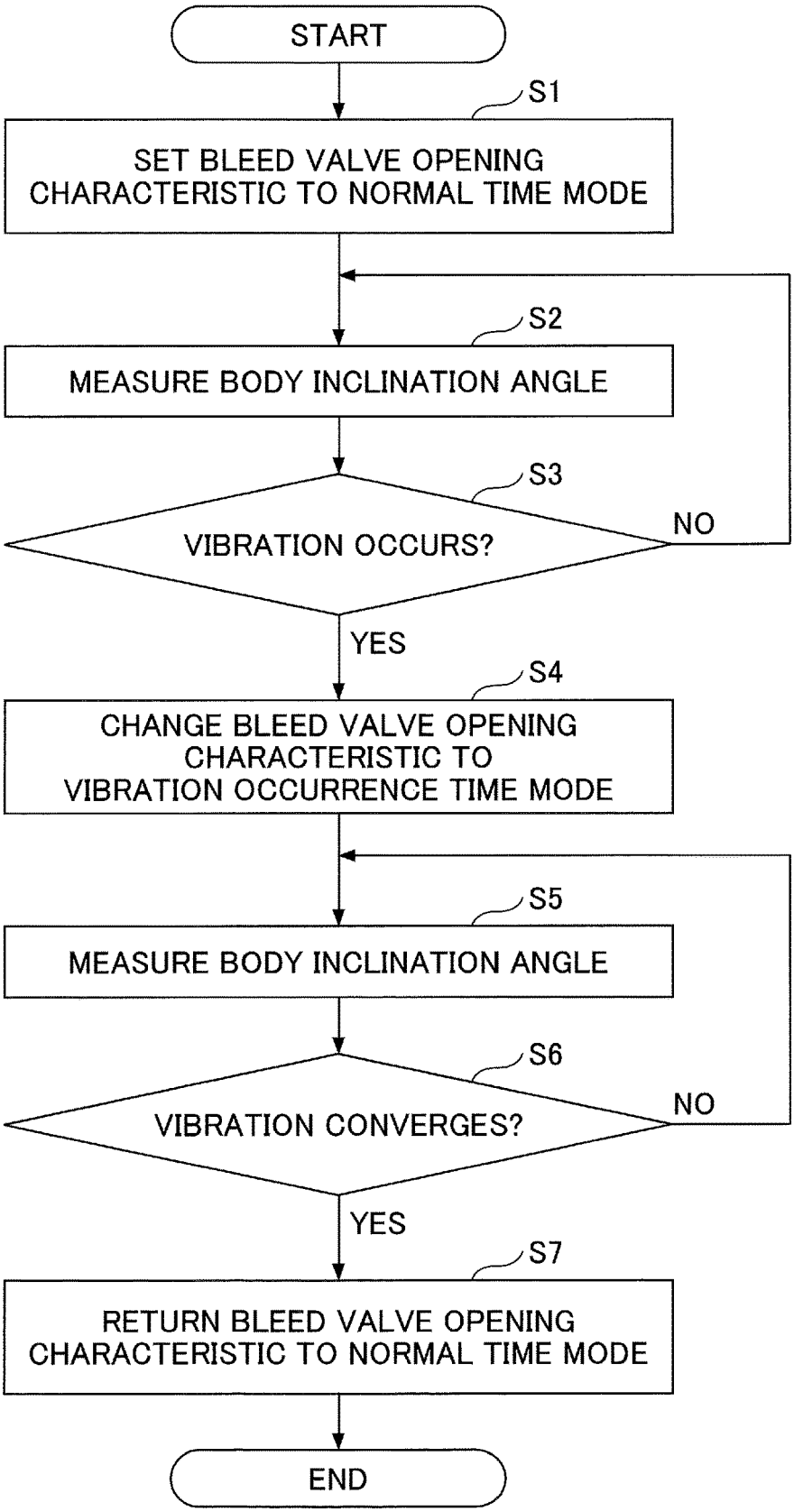
FIG. 6 is a flowchart of acceleration and deceleration characteristic control executed by an acceleration and deceleration characteristic control part.

Next, a process of controlling the acceleration and deceleration characteristics of a hydraulic actuator by changing the opening area of the bleed valves 177L and 177R by the acceleration and deceleration characteristic control part 300 is described with reference to FIG. 6. FIG. 6 is a flowchart of acceleration and deceleration characteristic control executed by the acceleration and deceleration characteristic control part 300. The acceleration and deceleration characteristic control part 300 repeatedly executes this process at predetermined control intervals while the shovel is in operation.

At step S1, the bleed valve opening characteristic is set to the normal time mode. The acceleration and deceleration characteristic control part 300 selects a bleed valve opening area commensurate with the amount of lever operation based on the bleed valve opening characteristic of the normal time mode as illustrated in FIG. 4, and determines a target electric current value for the proportional valves 31L1 and 31R2 to achieve the selected bleed valve opening area. Thereafter, the acceleration and deceleration characteristic control part 300 outputs an electric current command corresponding to the target electric current value to the proportional valves 31L1 and 31R2.

At step S2, the body inclination angle is measured. The acceleration and deceleration characteristic control part 300 may calculate the body inclination angle based on the output information of the body tilt sensor 32.

At step S3, it is determined whether vibration is occurring in the shovel body. The acceleration and deceleration characteristic control part 300 detects the occurrence of vibration based on the chronological information of the body inclination angle measured at step S2. For example, when the amplitude or frequency of the chronological information of the body inclination angle is more than or equal to a predetermined threshold, the acceleration and deceleration characteristic control part 300 may determine that the chronological information of the body inclination angle has the waveform of the vibration occurrence time illustrated in FIG. 5 and detect the occurrence of vibration. In the case of detecting the occurrence of vibration (YES at step S3), the acceleration and deceleration characteristic control part 300 proceeds to step S4. In the case of detecting no occurrence of vibration (NO at step S3), the acceleration and deceleration characteristic control part 300 returns to step S2, and the bleed valve opening characteristic is kept in the normal time mode.

At step S4, because it is determined at step S3 that vibration is occurring in the shovel body, the bleed valve opening characteristic is changed from the normal time mode to the vibration occurrence time mode. At this point, the proportional valves 31L1 and 31R1 reduce a secondary pressure that acts on the pilot ports of the bleed valves 177L and 177R. This increases the opening area of the bleed valves 177L and 177R to increase the bleed flow rate and reduce the actuator flow rate. As a result, it is possible to reduce the responsiveness to and lower the acceleration and deceleration characteristic with respect to the operation of a lever of the operating apparatus 26.

At step S5, the body inclination angle is measured the same as at step S2.

At step S6, it is determined whether the vibration that has occurred in the shovel body has converged. For example, the same as at step S3, the acceleration and deceleration characteristic control part 300 may detect the convergence of vibration based on the waveform of the body inclination angle measured at step S5. In the case of detecting the convergence of vibration (YES at step S6), the acceleration and deceleration characteristic control part 300 proceeds to step S7. In the case of detecting no convergence of vibration (NO at step S6), because the shovel body is still vibrating, the acceleration and deceleration characteristic control part 300 returns to step S5, and the bleed valve opening characteristic is kept in the vibration occurrence time mode until the vibration converges.

At step S7, because it is determined at step S6 that the vibration of the shovel body has converged, the bleed valve opening characteristic is returned from the vibration occurrence time mode to the normal time mode, and this control flow ends.

Effects according to the shovel of this embodiment are described. The shovel according to this embodiment includes the boom cylinder 7 and the arm cylinder 8 serving as hydraulic actuators, the arm operating lever 26A and the boom operating lever 26B serving as operating apparatuses used for operating the hydraulic actuators, and the acceleration and deceleration characteristic control part 300 of the controller 30 serving as a control device that performs such control as to reduce the responsiveness of hydraulic actuators to the operation of the operating apparatuses, in response to detection of the vibration of the shovel body. More specifically, the acceleration and deceleration characteristic control part 300 performs such control as to lower the acceleration and deceleration characteristic of hydraulic actuators with respect to the operation of the operating apparatuses, in response to detection of the vibration of the shovel body.

For example, when the operator operates the shovel where the shovel is on unstable ground, for example, on an obstacle such as wood or a stone, even a small lever operation may cause the shovel to vibrate. This vibration may cause hand hunting, resulting in the amplification of the vibration of the shovel body. To address this problem, according to this embodiment, the above-described configuration makes it possible to cause a hydraulic actuator to be slower to respond to the operation of a lever by the shovel operator by lowering the acceleration and deceleration characteristic of the hydraulic actuator, when vibration occurs in the shovel body. Accordingly, even when vibration occurs to shake the operator to cause hand hunting, it is possible to prevent this hand hunting from amplifying the vibration of the shovel body.

Furthermore, according to the shovel of this embodiment, the controller 30 detects the vibration of the shovel body based on changes in the body inclination angle. Because changes in the body inclination angle are highly relevant to the vibration of the shovel body, it is possible to detect vibration with accuracy. This makes it possible to prevent the acceleration and deceleration characteristic of a hydraulic actuator from being unnecessarily changed because of erroneous detection of the occurrence of vibration when it is actually unnecessary to lower the acceleration and deceleration characteristic.

The shovel according to this embodiment includes the lower traveling body 1, the upper turning body 3 turnably mounted on the lower traveling body 1, the main pumps 14L and 14R mounted on the upper turning body 3, and the bleed valves 177L and 177R that control the flow rate of a portion of hydraulic oil discharged by the main pumps 14L and 14R which portion flows to the hydraulic oil tank through no hydraulic actuators. The controller 30 controls the acceleration and deceleration characteristic of hydraulic actuators by changing the opening area of the bleed valves 177L and 177R.

The bleed valves 177L and 177R are valves that control the bleed flow rate of hydraulic oil discharged by the main pumps 14L and 14R. Therefore, by changing the opening area of the bleed valves 177L and 177R, it is possible to change the flow rate of hydraulic oil supplied to the hydraulic actuators (the boom cylinder 7, the arm cylinder 8, the bucket cylinder 9, the left side traveling hydraulic motor 1A, the right side traveling hydraulic motor 1B, and the turning hydraulic motor 2A) (actuator flow rate) at a time. This makes it possible to easily and simply control changing the acceleration and deceleration characteristic of hydraulic actuators.

Figure 7:
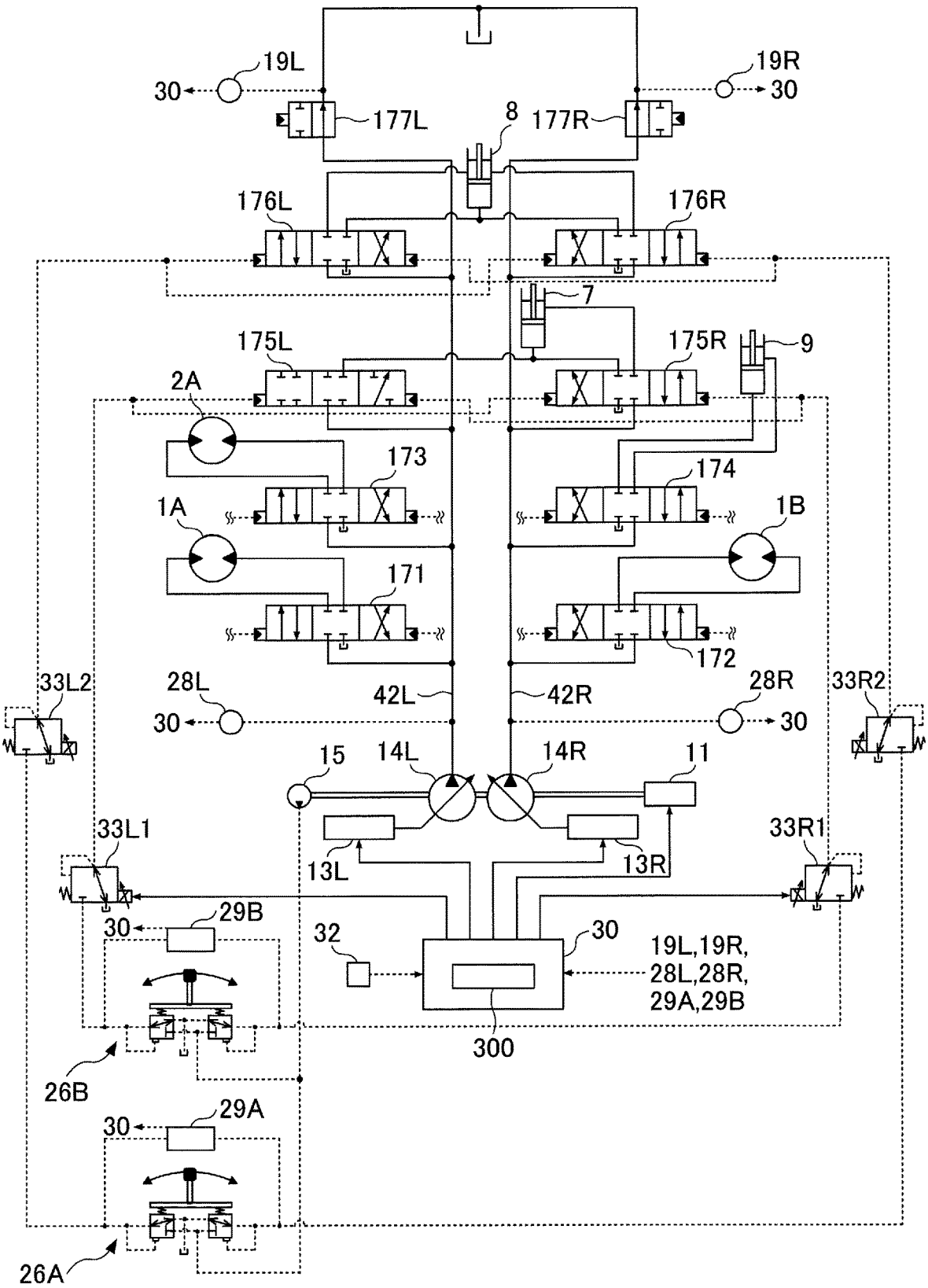
FIG. 7 is a schematic diagram illustrating an example configuration of a hydraulic circuit installed in a shovel according to another embodiment.

Next, another embodiment is described with reference to FIGS. 7 and 8. FIG. 7 is a schematic diagram illustrating an example configuration of a hydraulic circuit installed in a shovel according to this embodiment. The hydraulic circuit illustrated in FIG. 7 is different from the hydraulic circuit of the above-described embodiment in that reducing valves 33L1, 33R1, 33L2 and 33R2 are provided instead of the proportional valves 31L1 and 31R1.

Differences from the hydraulic circuit of the above-described embodiment are described below.

The controller 30 receives the outputs of the operating pressure sensors 29A and 29B, etc., and outputs a control command to the regulators 13L and 13R to change the discharge quantity of the main pumps 14L and 14R on an as-needed basis. Furthermore, the controller 30 outputs an electric current command to the reducing valves 33L1 and 33R1 to reduce a secondary pressure introduced to pilot ports of the control valves 175L and 175R according to the amount of operation of the boom operating lever 26B. Furthermore, the controller 30 outputs an electric current command to the reducing valves 33L2 and 33R2 to reduce a secondary pressure introduced to pilot ports of the control valves 176L and 176R according to the amount of operation of the arm operating lever 26A.

According to this embodiment, the same as in the above-described embodiment, the acceleration and deceleration characteristic control part 300 of the controller 30 controls the acceleration and deceleration characteristic of a hydraulic actuator with respect to the operation of a lever (or the operation of a pedal) of the operating apparatus 26 according to the presence or absence of the occurrence of vibration in the shovel body. This makes it possible to improve the operator's work efficiency, reduce the operator's fatigue, and improve the operator's safety.

Figure 8:
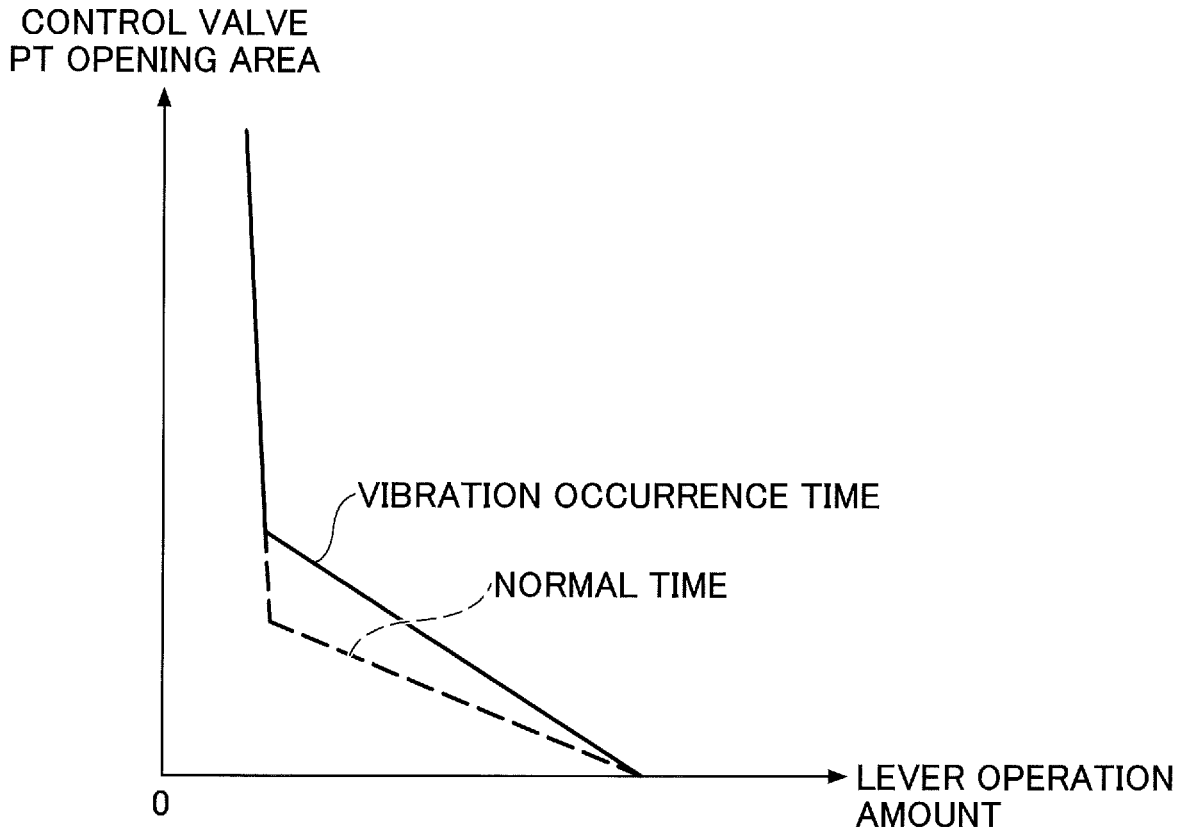
FIG. 8 is a graph illustrating a relationship between the amount of lever operation and the PT opening area of a control valve according to work modes.

FIG. 8 is a graph illustrating a relationship between the amount of lever operation and the PT opening area of a control valve according to work modes. The PT opening area of a control valve means an opening area between a port of the control valves 175L and 175R that communicates with the main pump 14L or 14R and a port of the control valves 175L and 175R that communicates with the hydraulic oil tank. Furthermore, the relationship between the amount of lever operation and the PT opening area of a control valve (hereinafter referred to as "control valve opening characteristic") may be, for example, either stored in a ROM or the like as a reference table or expressed by a predetermined calculating formula.

The acceleration and deceleration characteristic control part 300 controls the PT opening area of a control valve by changing the control valve opening characteristic in accordance with the presence or absence of the occurrence of vibration in the shovel body. For example, as illustrated in FIG. 8, on condition that the amount of lever operation remains the same, the acceleration and deceleration characteristic control part 300 causes the PT opening area of the control valves 175L and 175R to be larger in the "vibration occurrence time mode" setting than in the "normal time mode" setting, in order to reduce the flow rate of hydraulic oil flowing to the boom cylinder 7 by increasing the flow rate of hydraulic oil flowing to the hydraulic oil tank in the "vibration occurrence time mode." This makes it possible to reduce the responsiveness to the operation of a lever of the operating apparatus 26 to lower the acceleration and deceleration characteristic.

More specifically, the acceleration and deceleration characteristic control part 300 increases or decreases the PT opening area of the control valves 175L and 175R by outputting a control command corresponding to a work mode to the reducing valves 33L1 and 33R1, for example. For example, when the "vibration occurrence time mode" is selected, the acceleration and deceleration characteristic control part 300 increases the PT opening area of the control valves 175L and 175R by reducing the secondary pressure of the reducing valves 33L1 and 33R1 by reducing an electric current command to the reducing valves 33L1 and 33R1, compared with when the "normal time mode" is selected.

Furthermore, the acceleration and deceleration characteristic control part 300 increases or decreases the PT opening area of the control valves 176L and 176R by outputting a control command corresponding to a work mode to the reducing valves 33L2 and 33R2, for example. For example, when the "vibration occurrence time mode" is selected, the acceleration and deceleration characteristic control part 300 increases the PT opening area of the control valves 176L and 176R by reducing the secondary pressure of the reducing valves 33L2 and 33R2 by reducing an electric current command to the reducing valves 33L2 and 33R2, compared with when the "normal time mode" is selected.

According to this embodiment, the acceleration and deceleration characteristic control part 300 executes a process to control the acceleration and deceleration characteristic of a hydraulic actuator by adjusting a pilot pressure that acts on the control valves 175L and 175R. This process has the same basic flow as the process of the above-described embodiment described with reference to FIG. 6, and is different from the above-described embodiment in that the characteristic changed according to the presence or absence of the occurrence of vibration is not the "bleed valve opening characteristic" of FIG. 4 but the "control valve opening characteristic" of FIG. 8.

The shovel of this embodiment includes the main pumps 14L and 14R mounted on the upper turning body 3 and the control valves 175L, 175R, 176L and 176R that control the flow of hydraulic oil from the main pumps 14L and 14R to hydraulic actuators (the boom cylinder 7 and the arm cylinder 8). The controller 30 controls the acceleration and deceleration characteristic of the hydraulic actuators by changing a pilot pressure that acts on the control valves 175L, 175R, 176L and 176R.

According to this configuration, by changing the pilot pressure of the control valves 175L, 175R, 176L and 176R connected to the hydraulic actuators, it is possible to control the acceleration and deceleration characteristic of the hydraulic actuators and to prevent amplification of the vibration of the shovel body due to hand hunting, the same as in the above-described embodiment. Furthermore, in contrast to the above-described embodiment, it is possible to control acceleration and deceleration characteristic of the hydraulic actuators individually by controlling the control valves 175L, 175R, 176L and 176R connected to the hydraulic actuators. Therefore, it is possible to increase control flexibility.

Figure 9:
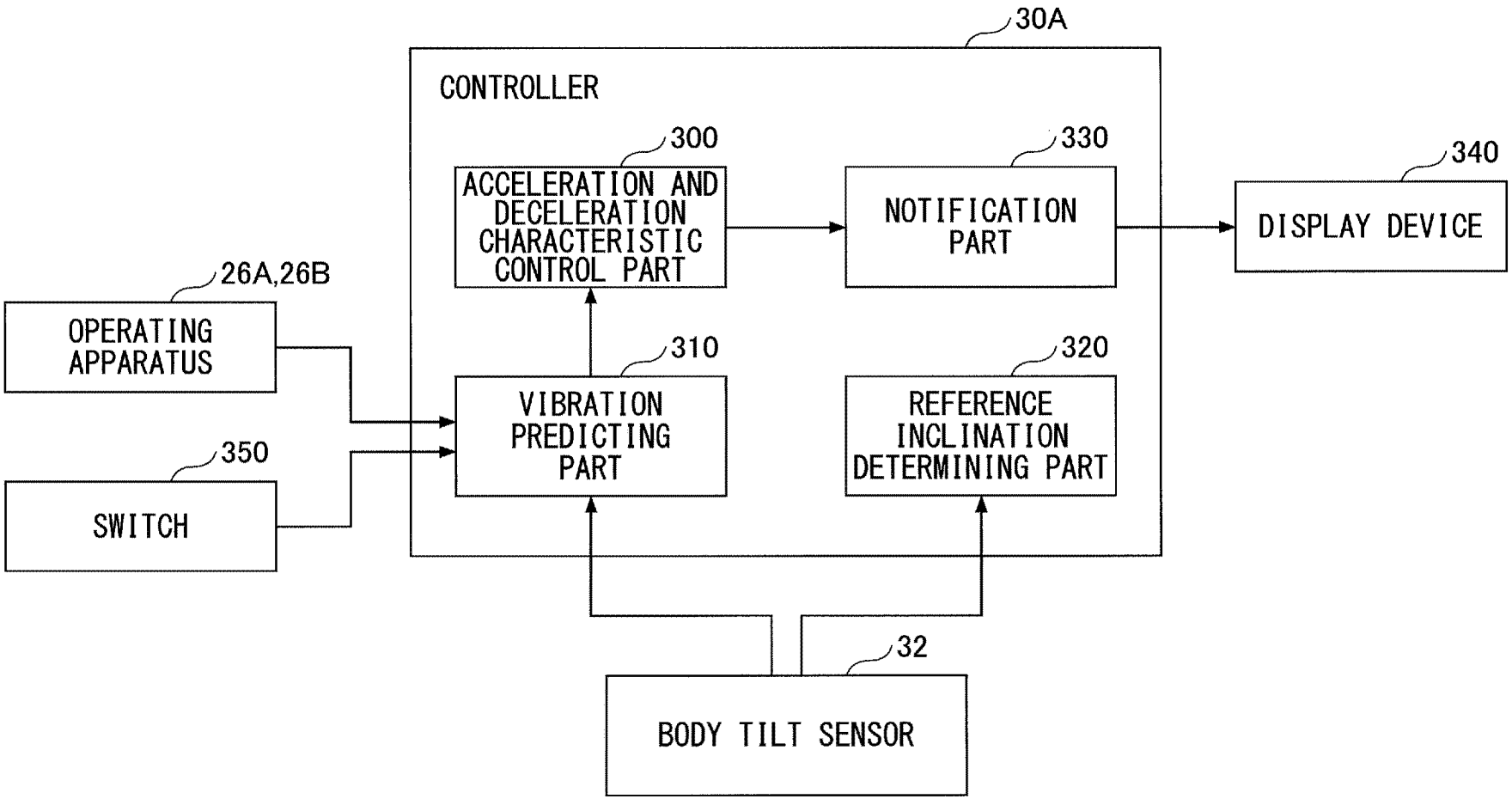
FIG. 9 is a block diagram illustrating an example configuration of a controller installed in a shovel according to yet another embodiment.

Yet another embodiment is described with reference to FIGS. 9 through 14. FIG. 9 is a block diagram illustrating an example configuration of a controller 30A installed in a shovel according to this embodiment. This embodiment is different from the above-described embodiments in the technique of determining "the occurrence of the vibration of the shovel body," which is a trigger for performing such control as to reduce the responsiveness of a hydraulic actuator.

The above-described embodiments illustrate changing the acceleration and deceleration characteristic of a hydraulic actuator after detecting the vibration of the shovel body, while the acceleration and deceleration characteristic may be changed to the vibration occurrence time mode in advance in a work condition where vibration is likely to occur as in this embodiment. In this case, for example, the controller 30A determines whether a work condition is such that vibration is likely to occur, on the basis of short-term or long-term sensing based on information from various sensors such as the body tilt sensor 32. In response to determining that the work condition is as such, the controller 30A predicts the occurrence of vibration and automatically adjusts the acceleration and deceleration characteristic. The controller 30A may obtain a criterion for determining a work condition that is likely to cause vibration from a database or by learning, for example.

As illustrated in FIG. 9, the controller 30A includes a vibration predicting part 310 and a reference inclination determining part 320 in addition to the acceleration and deceleration characteristic control part 300 described in the above-described embodiments as well.

The vibration predicting part 310 determines whether a work condition is such that the vibration of the shovel body is likely to occur, on the basis of short-term or long-term sensing based on information from various sensors such as the body tilt sensor 32, and predicts the occurrence of the vibration of the shovel body. The acceleration and deceleration characteristic control part 300 performs such control as to reduce the responsiveness of a hydraulic actuator, in response to the determination of the occurrence of vibration by the vibration predicting part 310.

Figure 10:
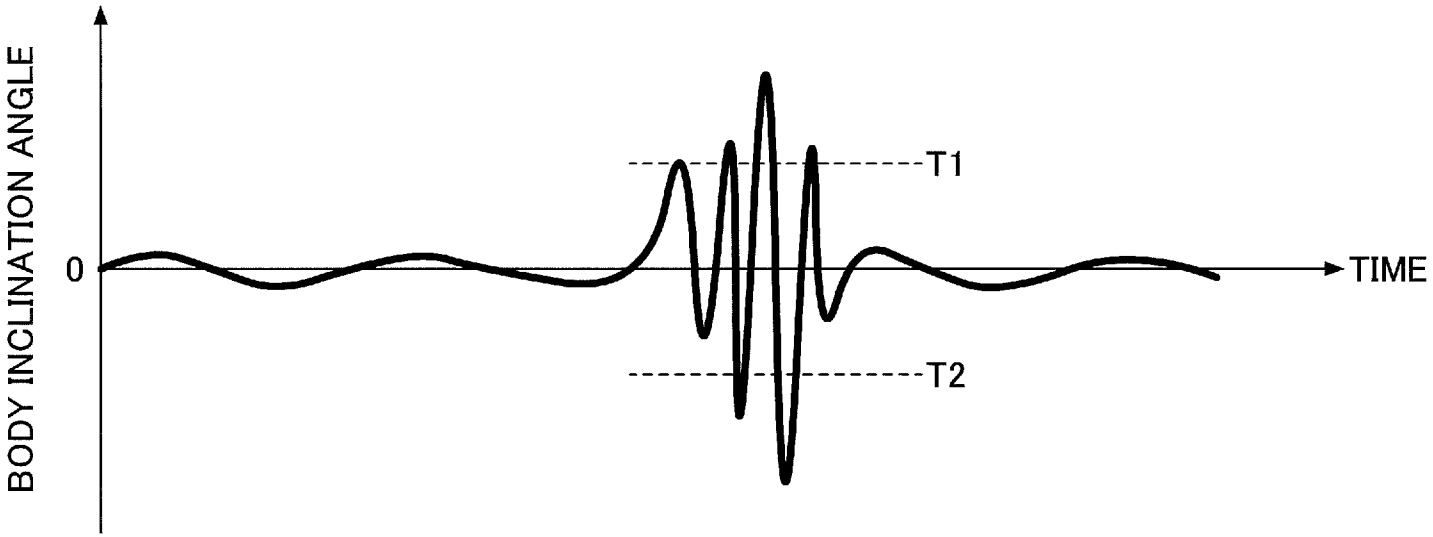
FIG. 10 is a graph for illustrating an example of a short-term sensing technique associated with the occurrence of vibration.

An example of a short-term sensing technique associated with the occurrence of vibration employed by the vibration predicting part 310 is described with reference to FIG. 10. FIG. 10 is a graph for illustrating an example of a short-term sensing technique associated with the occurrence of vibration. FIG. 10 illustrates waveform examples of the body inclination angle at the normal time and the vibration occurrence time, which are equal to those of FIG. 5. According to this detection technique, as illustrated in FIG. 10, values that are not reached by the waveform of the normal time and are reached by the waveform of the vibration occurrence time are set as predetermined thresholds T1 and T2 in the positive and the negative direction of the body inclination angle. The vibration predicting part 310 may determine the occurrence of vibration when the measured value of the body tilt sensor 32 reaches each of the thresholds T1 and T2 a predetermined number of times during a predetermined short-term period of approximately one to five seconds.

According to this configuration, after passage of the predetermined period since the occurrence of vibration (for example, six seconds later), the acceleration and deceleration characteristic control part 300 performs such control as to reduce the responsiveness of a hydraulic actuator to prevent the vibration from causing hand hunting, so that it is thereafter possible to reduce vibration even where the shovel is on unstable ground.

Furthermore, the vibration predicting part 310 may determine the occurrence of vibration in response to additionally detecting that an input to an operating apparatus (the arm operating lever 26A, the boom operating lever 26B or the like) is vibratory, when the waveform of the body inclination angle reaches each of the thresholds T1 and T2 a predetermined number of time during the predetermined period. The same as in the sensing technique for the vibration of the shovel body, it may be determined that an input to an operating apparatus is vibratory when the input to the operating apparatus reaches a predetermined positive or negative threshold a predetermined number of times, for example.

Even when the vibration predicting part 310 predicts the occurrence of vibration, the acceleration and deceleration characteristic control part 300 may operate differently by determining whether to put a vibration preventing function into operation in accordance with the shovel operator's technique, such as by maintaining the responsiveness of a hydraulic actuator as is in the case of an experienced shovel operator and reducing the responsiveness of a hydraulic actuator or assisting with operations in the case of an inexperienced shovel operator. In this case, for example, a list of shovel operators may be recorded in the internal memory of the controller 30A or the like, so that the controller 30A may identify a current operator through a technique such as an operator's selecting operation or face detection with a camera. Furthermore, when the operating direction is a direction to reduce vibration, the vibration preventing function may be stopped.

Alternatively, the operator may select a support level in accordance with her/his self-recognized skills. For example, a support level display part 344 that can display and allow a selection from multiple support levels (for example, five levels of Levels 1 through 5) of the vibration preventing function may be provided in a display device 340 installed in the cabin 10 (see FIG. 13). This enables an operator who is aware of her/his operational proficiency to select a suitable level of operation suppression support by her/himself and to enjoy support commensurate with her/his self-recognized skills from the machine.

Figure 11:
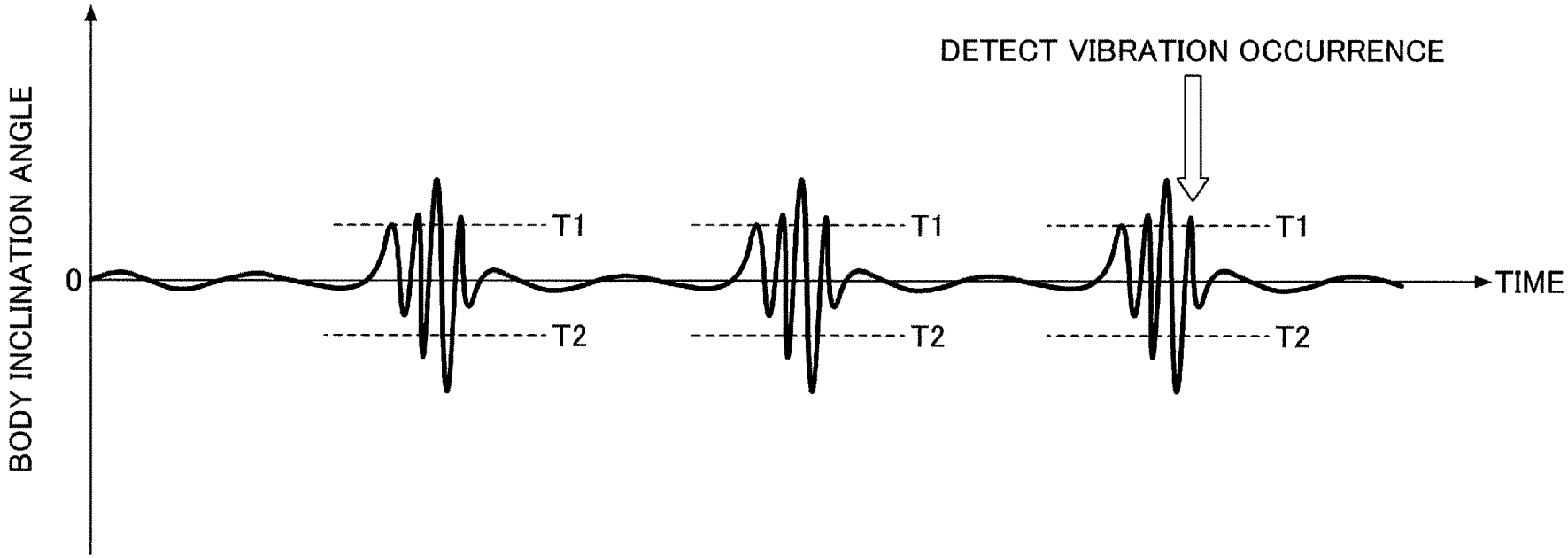
FIG. 11 is a graph for illustrating an example of a long-term sensing technique associated with the occurrence of vibration.

An example of a long-term sensing technique associated with the occurrence of vibration employed by the vibration predicting part 310 is described with reference to FIG. 11. FIG. 11 is a graph for illustrating an example of a long-term sensing technique associated with the occurrence of vibration. FIG. 11 illustrates waveform examples of the body inclination angle at the normal time and the vibration occurrence time, where the same waveform as in FIG. 10 is repeated three times. The vibration predicting part 310 may determine that the ground is rough and vibration is likely to occur when short-term vibration sensing as in FIG. 10 occurs an appropriate number of times (three times in FIG. 11) during a predetermined long-term period (for example, one minute) as illustrated in FIG. 11.

Referring back to FIG. 9, the reference inclination determining part 320 determines the inclination angle of a location where the shovel is performed work relative to a horizontal as a reference inclination. For example, when the shovel is performing work on sloping ground, the reference inclination determining part 320 may calculate the inclination angle of the sloping ground based on information on the average of body inclination angle during a predetermined period and determine the inclination angle as a reference inclination.

Figure 12:
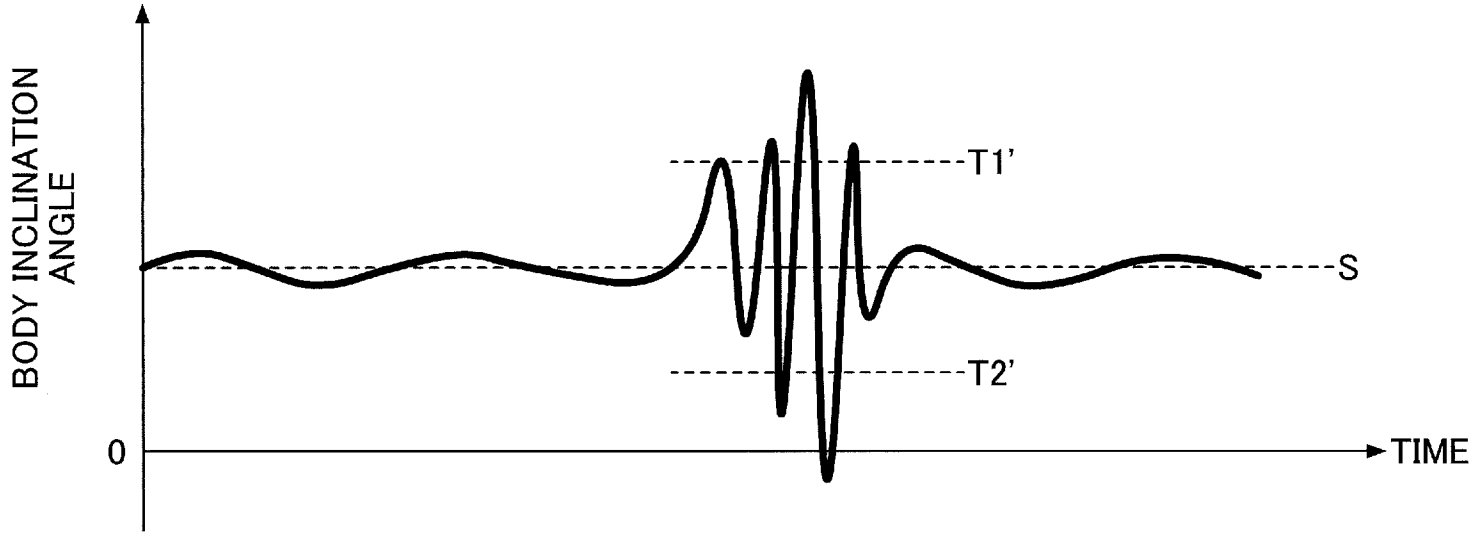
FIG. 12 is a graph for illustrating an example vibration determination using a reference inclination.

The vibration predicting part 310 may determine the occurrence of vibration using the reference inclination determined by the reference inclination determining part 320. FIG. 12 is a graph for illustrating an example vibration determination using the reference inclination. FIG. 12 illustrates waveform examples of the body inclination angle at the normal time and the vibration occurrence time, where the center of vibration is offset from zero degrees compared with FIG. 10. This offset of the vibration center from zero degrees corresponds to a reference inclination S determined by the reference inclination determining part 320. According to the illustration of FIG. 12, the vibration predicting part 310 sets positive and negative thresholds T1' and T2' by shifting the thresholds T1 and T2 of FIG. 10 to the direction of the reference inclination S. This configuration makes it possible to predict the occurrence of vibration with accuracy even under various inclination conditions to further ensure prevention of the occurrence of vibration.

When the vibration predicting part 310 employs the long-term sensing technique, the reference inclination determining part 320 may determine the reference inclination S each time and provides the vibration predicting part 310 with the reference inclination S. The vibration predicting part 310 detects the frequency of occurrence of vibration in the body inclination angle based on the reference inclination S of each time.

As illustrated in FIG. 9, the controller 30A further includes a notification part 330. When the acceleration and deceleration characteristic control part 300 performs the control of reducing the responsiveness of a hydraulic actuator or performs the control of returning the responsiveness of a hydraulic actuator to the normal-time characteristic, the notification part 330 may so notify the shovel operator. The notification part 330 is displayed on, for example, the display device 340 installed in the cabin 10.

Providing such a function of the notification part 330 enables the shovel operator to be aware of a change in the responsiveness of a hydraulic actuator and perform a proper operation. This makes it possible to prevent work efficiency from being reduced.

Furthermore, as illustrated in FIG. 9, the vibration predicting part 310 may include a function to turn on/off an operation with an operating device such as a switch 350. It may be desired to vibratorily operate the shovel, for example, shake the bucket 6 to remove mud adhering thereto. In such a case, the operator may turn off the switch 350 to stop the operation of the acceleration and deceleration characteristic control part 300 to stop the control of reducing the responsiveness of a hydraulic actuator. This makes it possible to prevent the responsiveness from being changed against the operator's intention.

Figure 13:
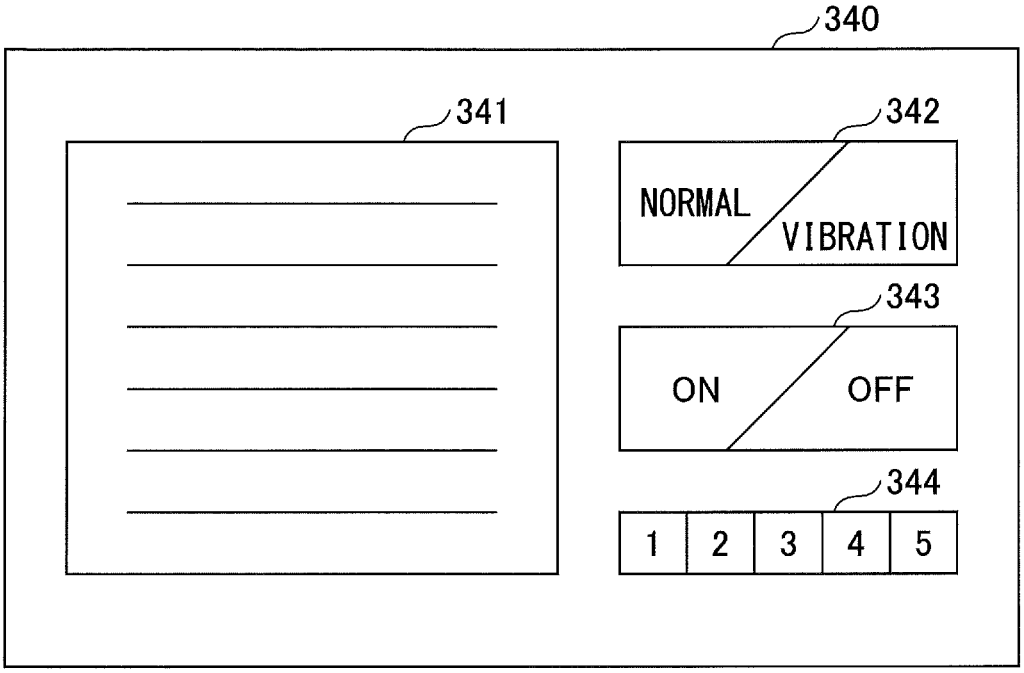
FIG. 13 is a diagram illustrating an example configuration of a display device.

FIG. 13 is a diagram illustrating an example configuration of the display device 340. As illustrated in FIG. 13, in addition to a display screen 341 that displays various kinds of information, the display device 340 may include a mode display part 342 that displays information imparted by the notification part 330 (for example, information as to whether the bleed valve opening characteristic of FIG. 4 is in the normal time mode or the vibration occurrence time mode) and an ON/OFF display part 343 that displays the ON/OFF state of a vibration determining function. The mode display part 342 and the ON/OFF display part 343 may be a display separated from the display screen 341 in terms of hardware, or may be a display integrated with the display screen 341 with part of the display screen 341 being separated in terms of software.

Figure 14:
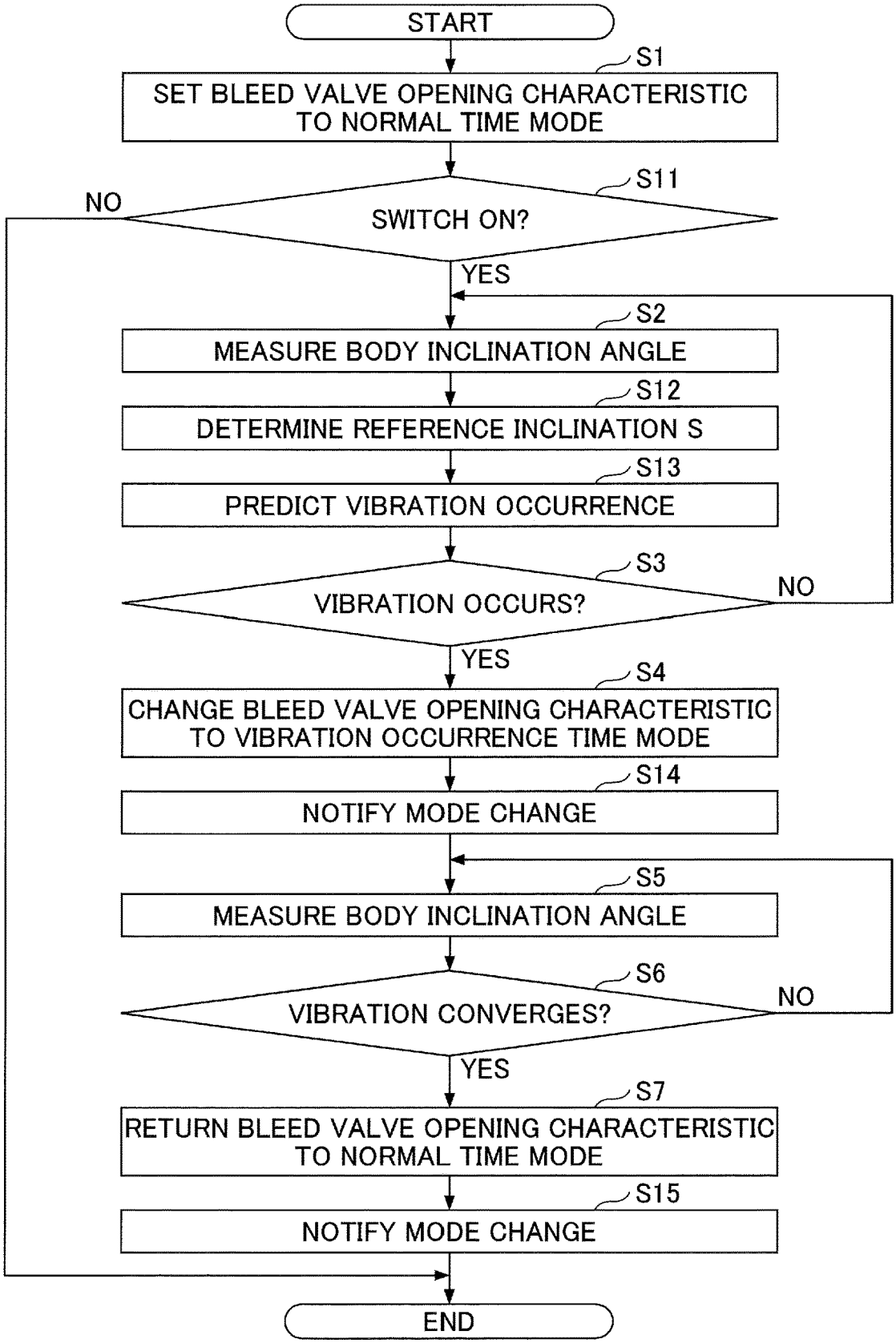
FIG. 14 is a flowchart of acceleration and deceleration characteristic control executed by the controller of FIG. 9.

FIG. 14 is a flowchart of acceleration and deceleration characteristic control executed by the controller 30A of this embodiment. A description of steps S1 through S7, which are equal to steps S1 through S7 of the flowchart of the above-described embodiment described with reference to FIG. 6, is omitted.

At step S11, the vibration predicting part 310 determines whether the switch 350 is ON. If the switch 350 is ON (YES at step S11), step S2 is entered. If not (NO at step S11), this control flow ends without executing the acceleration and deceleration characteristic control because the vibration determining function is stopped by the shovel operator.

At step S12, the reference inclination determining part 320 determines the reference inclination S. The reference inclination determining part 320 determines the reference inclination S based on the chronological information of the body inclination angle measured at step S2 and outputs the reference inclination S to the vibration predicting part 310. When the process of step S12 is completed, step S13 is entered.

At step S13, the vibration predicting part 310 predicts the occurrence of vibration in the shovel body. The vibration predicting part 310 predicts the occurrence of vibration in the shovel body on the basis of short-term or long-term sensing based on the chronological information of the body inclination angle measured at step S2. The vibration predicting part 310 may determine that vibration is likely to occur in response to detecting that an input to an operating apparatus such as the arm operating lever 26A, the boom operating lever 26B or the like is vibratory. The vibration predicting part 310 outputs the result of a determination as to the occurrence of vibration to the acceleration and deceleration characteristic control part 300. At step S3, the acceleration and deceleration characteristic control part 300 operates according to the presence or absence of the occurrence of vibration based on the determination result of the vibration predicting part 310.

At step S14, the notification part 330 notifies the shovel operator that the bleed valve opening characteristic has been changed from the normal time mode to the vibration occurrence time mode at step S4 via the mode display part 342 of the display device 340. When the process of step S14 is completed, step S5 is entered.

At step S15, the notification part 330 notifies the shovel operator that the bleed valve opening characteristic has been returned from the vibration occurrence time mode to the normal time mode at step S7 via the mode display part 342 of the display device 340. When the process of step S15 is completed, this control flow ends.

The controller 30A of this embodiment may include only one or some of the functions pertaining to the vibration predicting part 310, the reference inclination determining part 320, and the notification part 330.

Embodiments are described above with reference to specific examples. The present disclosure, however, is not limited to these specific examples. These specific examples may be suitably subjected to design change by a person of ordinary skill in the art within the scope of the present disclosure to the extent that they have the features of the present disclosure. The elements and their arrangement, conditions, shapes, etc., of the above-described specific examples are not limited to those illustrated, and may be suitably changed. The elements of the above-described specific examples may be suitably combined differently to the extent that no technical contradiction is caused.

Regarding the above-described process of controlling the acceleration and deceleration characteristic, the case of increasing or decreasing only the acceleration and deceleration characteristic according to a work mode is described. In addition to the acceleration and deceleration characteristic, however, the rotational speed of the engine 11 that drives the main pumps 14L and 14R may be increased or decreased. For example, when the "vibration occurrence time mode" is selected, the rotational speed of the engine 11 may be decreased to reduce the pump flow rate. The pump flow rate may also be reduced by reducing the discharge quantity per revolution by controlling the tilt angle of the main pumps 14L and 14R. Alternatively, only the control of reducing the pump flow rate instead of the acceleration and deceleration characteristic may be executed.

According to the above-described embodiments, the boom cylinder 7 and the arm cylinder 8 are illustrated as hydraulic actuators subjected to the control of changing the acceleration and deceleration characteristic at the occurrence of vibration, while other hydraulic actuators such as the bucket cylinder 9, the left side traveling hydraulic motor 1A, the right side traveling hydraulic motor 1B, and the turning hydraulic motor 2A may also be used. Likewise, according to the above-described embodiments, the arm operating lever 26A and the boom operating lever 26B are illustrated as operating apparatuses used to operate hydraulic actuators, while other operating apparatuses such as left and right travel levers (or pedals), a bucket operating lever, and a turning operating lever.

Figure 15:
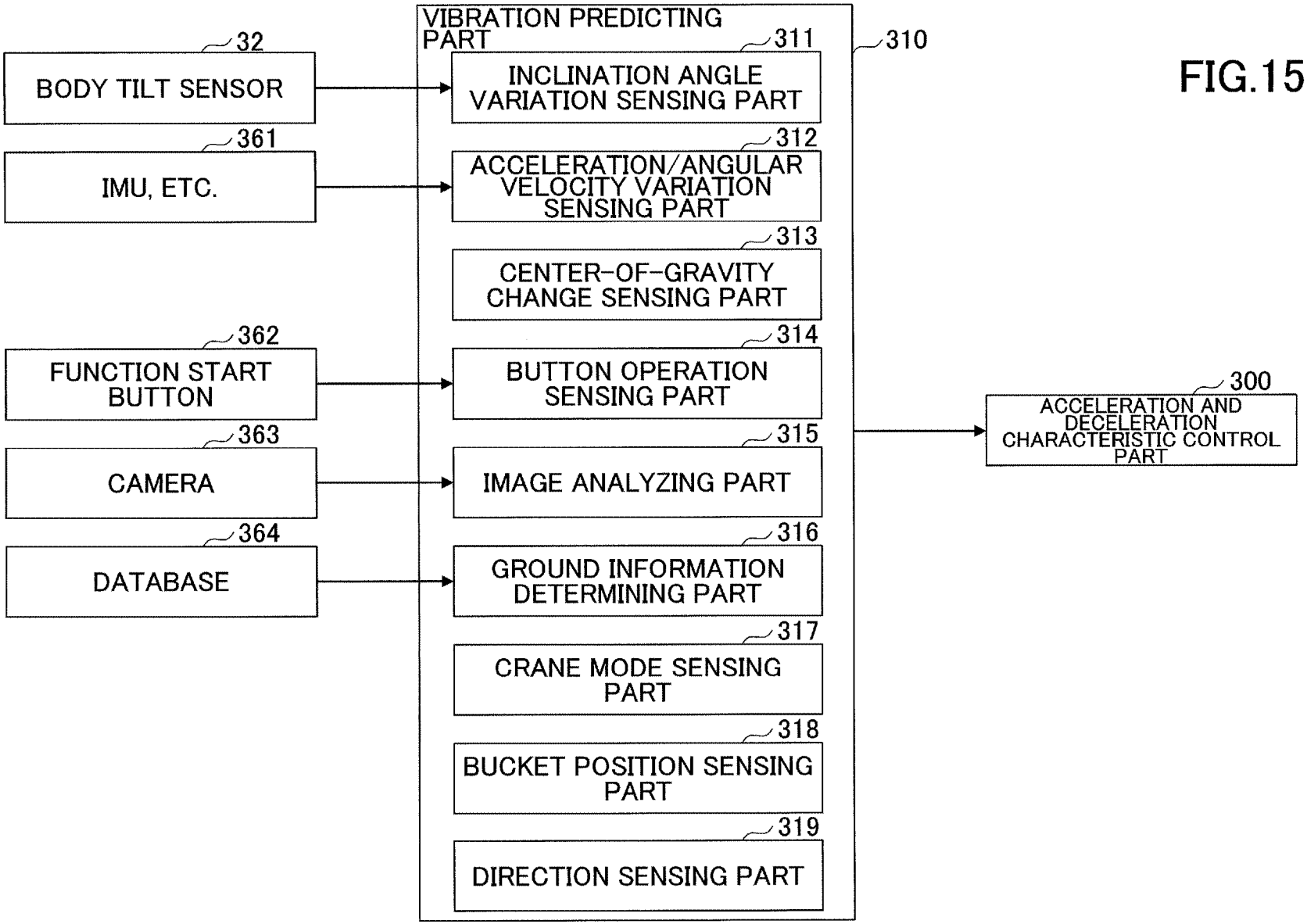
FIG. 15 is a block diagram illustrating another example configuration of the acceleration and deceleration characteristic control part of FIG. 3 and a vibration predicting part of FIG. 9.

According to the above-described embodiments, the acceleration and deceleration characteristic control part 300 of FIG. 3 and the vibration predicting part 310 of FIG. 9 detect or predict the occurrence of vibration based on the body inclination angle measured using the body tilt sensor 32, while the technique of sensing the occurrence of vibration is not limited to this. For example, as illustrated in FIG. 15, various vibration sensing parts other than that based on the body inclination angle may be provided. This is illustrated as a variation of the vibration predicting part 310 of FIG. 9 in FIG. 15 for convenience of description, but may also be applied to the acceleration and deceleration characteristic control part 300 of FIG. 3.

FIG. 15 is a block diagram illustrating a variation of the vibration predicting part 310 of FIG. 9. As illustrated in FIG. 15, the vibration predicting part 310 includes an inclination angle variation sensing part 311, an acceleration/angular velocity variation sensing part 312, a center-of-gravity change sensing part 313, a button operation sensing part 314, an image analyzing part 315, a ground information determining part 316, a crane mode sensing part 317, a bucket position sensing part 318, a direction sensing part 319.

The inclination angle variation sensing part 311 may detect or predict the occurrence of vibration based on the body inclination angle measured using the body tilt sensor 32 the same as in the above-described embodiments.

The acceleration/angular velocity variation sensing part 312 may detect or predict the occurrence of vibration based on acceleration information or angular velocity information measured by a sensor 361 or the like that may include a gyroscope, an acceleration sensor, an IMU (Inertial Measurement Unit), etc., instead of the body tilt sensor 32.

The center-of-gravity change sensing part 313 may detect or predict the occurrence of vibration based on a change in the position of the center of gravity of the shovel or a change in the position or velocity of the shovel.

The position of the center of gravity of the shovel changes according to the shovel's current situation. Such a situation may include the angle of a slope, the orientation of the turning body, the weight of the bucket, the rotational speed of the engine, a work mode, etc.

For example, the position of the bucket or the movement of the attachment that destabilizes the vehicle body changes according to the weight of soil loaded in the bucket or the weight of a load at a crane mode time. Accordingly, the weight of the bucket is suitable as a parameter that defines a change in the position of the center of gravity of the shovel.

The base value (upper limit value) of the amount of hydraulic oil discharged from the main pump changes. Therefore, the velocity of the attachment actually changes. Accordingly, the rotational speed of the engine is suitable as a parameter that defines a change in the position of the center of gravity of the shovel.

Furthermore, work modes (such as power, normal, eco, etc.) can be switched depending the shovel. In this case, the behavior of the shovel in response to the same operational input changes according to the work mode. Therefore, the work mode is suitable as a parameter that defines a change in the position of the center of gravity of the shovel. Information on the position and velocity of the shovel may be obtained using, for example, the GPS.

The button operation sensing part 314 may detect (predict) that vibration is likely to occur, for example, when the operator, who is about to head toward rough ground or move onto scrap, actively presses a function start button 362 provided for exerting the vibration preventing function. This is because vibration is likely to occur in the shovel body because of dynamic external disturbance from the ground or dynamic external disturbance due to the movement of the shovel itself where the stability of the shovel is relatively reduced, such as on rough ground or scrap.

The image analyzing part 315 may sense or predict the occurrence of vibration when an image of an area in front of the travel position of the shovel is captured with a camera 363 (an image capturing device) and rough ground is recognized based on the camera image. This is because vibration is likely to occur in the shovel body where the stability of the shovel is relatively reduced, such as on rough ground. Furthermore, the image analyzing part 315 may sense or predict the occurrence of vibration based on the magnitude of blurring of an image captured by the camera 363 or the result of determining the irregularities of the ground by performing image recognition on an image captured by the camera 363. This is because it may be determined that vibration is occurring or vibration may occur when image blurring is relatively large. Furthermore, this is because when ground irregularities relatively increase, the stability of the shovel body relatively decreases, so that vibration is likely to occur in the shovel body because of dynamic external disturbance from the ground or dynamic external disturbance due to the movement of the shovel itself.

The ground information determining part 316 may sense or predict the occurrence of vibration by obtaining information such as that the shovel is positioned on rough, irregular, or rugged ground based on ICT (Information and Communication Technology) information that may be obtained from a database 364. As described above, where the ground is rough, includes relatively large irregularities, or rugged, the stability of the shovel body relatively decreases, so that vibration is likely to occur in the shovel body because of dynamic external disturbance from the ground or dynamic external disturbance due to the movement of the shovel itself.

The crane mode sensing part 317 may sense or predict the occurrence of vibration at the start of a crane mode. This is because in the crane mode, a load is suspended from a hook, attached to the distal end of the arm 5 as an end attachment, through a wire, so that vibration is likely to occur in the shovel body in response to dynamic external disturbance from the ground or dynamic external disturbance due to the movement of the shovel itself.

The bucket position sensing part 318 may detect the position of the bucket 6 and sense or predict the occurrence of vibration according to the position of the bucket 6. This is because, for example, when the bucket 6 is away from the shovel body, the center of gravity moves outward from the center of the shovel body to relatively decrease the stability of the shovel body, so that the shovel body is likely to vibrate because of dynamic external disturbance from the ground or dynamic external disturbance due to the movement of the shovel itself.

Figure 16:
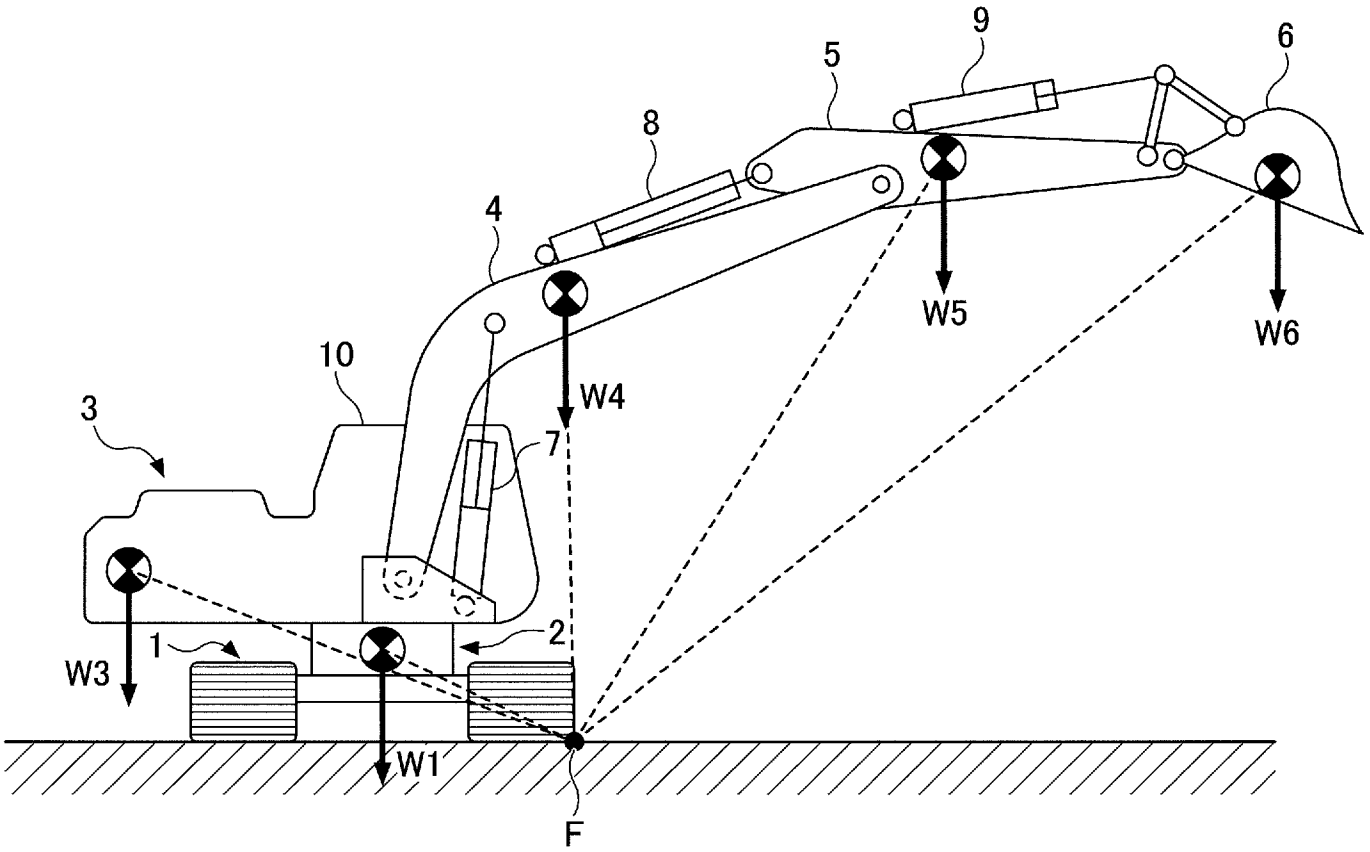
FIG. 16 is a diagram illustrating an example of a situation where vibration is likely to occur in a shovel body.

For example, FIG. 16 is a diagram illustrating an example of the situation where vibration is likely to occur in the shovel body.

As illustrated in FIG. 16, a static moment of overturning to overturn the shovel body forward around a tipping fulcrum F due to a self-weight W4 of the boom 4, a self-weight W5 of the arm 5, and a self-weight W6 of the bucket 6 (including an object accommodated in the bucket 6) (hereinafter, "static overturning moment") is acting on the shovel. On the other hand, a preventing moment to prevent the overturning of the shovel body around the tipping fulcrum F due to a self-weight W1 of the lower traveling body 1 including the self-weight of the turning mechanism 2 and a self-weight W3 of the upper turning body 3 is acting on the shovel. At this point, the tipping fulcrum F corresponds to the end of the ground contact surface of the lower traveling body 1 along the direction of the attachment. Therefore, when the position of the bucket 6 is relatively distant from the shovel body, the static overturning moment relatively increases to relatively decrease the stability of the shovel body. Accordingly, in such a situation, if a dynamic moment of overturning to lift the rear because of dynamic external disturbance from the outside such as the ground or dynamic external disturbance due to the movement of the shovel itself (hereinafter, "dynamic overturning moment") further acts on the shovel body, vibration is likely to occur in the shovel body.

In particular, as illustrated in FIG. 16, when the bucket 6 is at a relatively high position above the ground, the position of the bucket 6 is farther away from the shovel body, specifically, the tipping fulcrum F. Therefore, in such a situation, vibration is more likely to occur in the shovel body because of dynamic external disturbance from the outside such as the ground or dynamic external disturbance due to the movement of the shovel itself. Accordingly, the bucket position sensing part 318 may predict that vibration is likely to occur in the shovel body when the position of the bucket 6 is relatively distant from the ground, specifically, when the height of the bucket 6 above the ground exceeds a predetermined threshold.

The direction sensing part 319 may detect the direction of the attachment (a direction in which the attachment extends from the upper turning body 3 in a plan view) with reference to the travel direction of the lower traveling body 1, and sense or predict the vibration of the shovel body according to a difference between the direction of the attachment and the travel direction of the lower traveling body 1.

Figure 17:
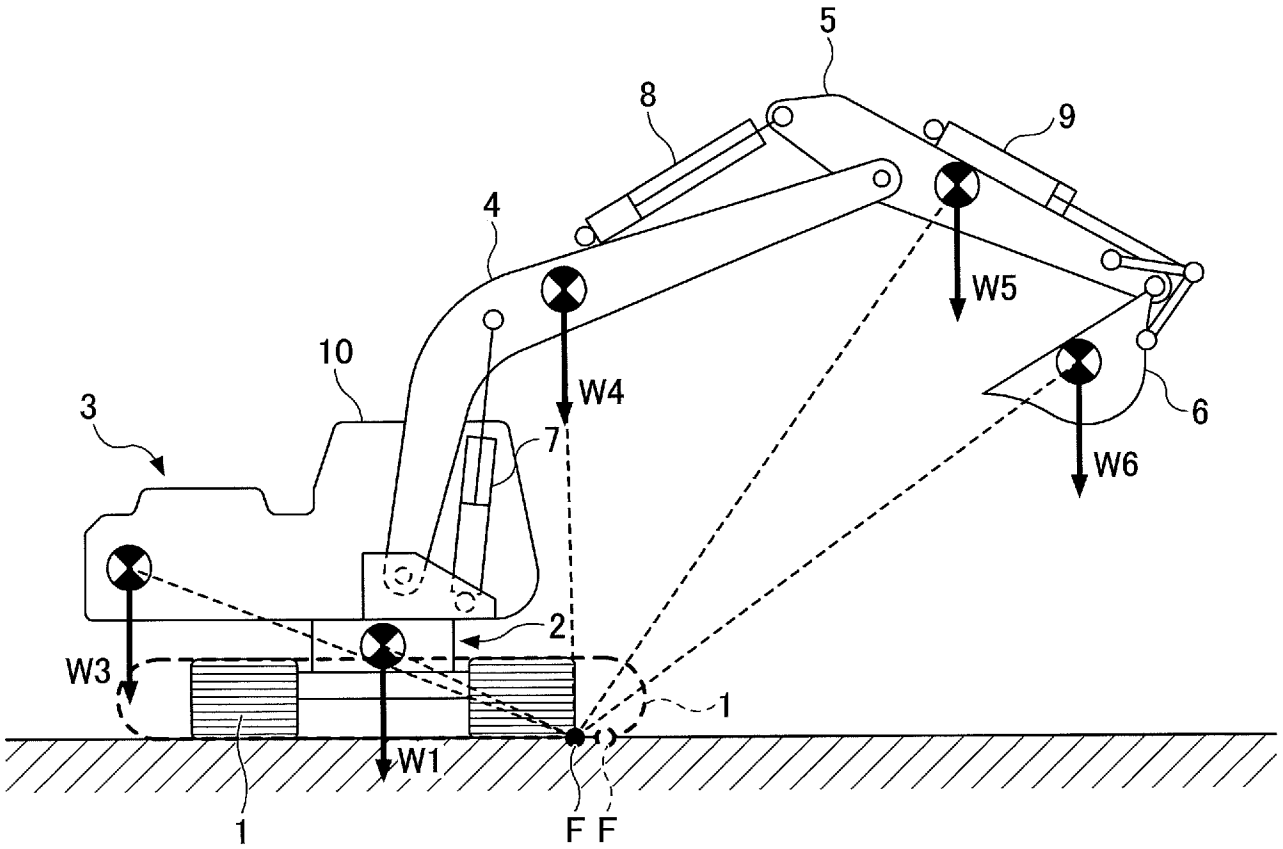
FIG. 17 is a diagram illustrating another example of the situation where vibration is likely to occur in the shovel body.

For example, FIG. 17 is a diagram illustrating another example of the situation where vibration is likely to occur in the shovel body.

As illustrated in FIG. 17, when the direction of the attachment substantially matches the travel direction of the lower traveling body 1 (in the case of the lower traveling body 1 of the dotted line in the drawing), the tipping fulcrum F (dotted line in the drawing) is farther from the position of the center of gravity of the shovel body. In this case, the preventing moment acting on the shovel body relatively increases, while the static overturning moment acting on the shovel body relatively decreases. In contrast, when the direction of the attachment is far apart and turned 90° from the travel direction of the lower traveling body 1 (in the case of the lower traveling body 1 of the solid line in the drawing), the tipping fulcrum F (solid line in the drawing) is closer to the position of the center of gravity of the shovel body. In this case, the preventing moment acting on the shovel body relatively decreases, while the static overturning moment acting on the shovel body relatively increases. Therefore, in such a situation, the stability of the shovel body relatively decreases. That is, in a situation where the direction of the attachment is relatively far apart from the travel direction of the lower traveling body 1, vibration is likely to occur in the shovel body because of dynamic external disturbance from the outside such as the ground or dynamic external disturbance due to the movement of the shovel itself. Therefore, the direction sensing part 319 may predict that vibration is likely to occur in the shovel body when the direction of the attachment is relatively far apart from the travel direction of the lower traveling body 1 (specifically, the angular difference between the direction of the attachment and the travel direction of the lower traveling body 1 in a plan view exceeds a predetermined threshold).

Thus, the acceleration and deceleration characteristic control part 300 of FIG. 3 and the vibration predicting part 310 of FIG. 9 may determine that vibration is likely to occur in the shovel body and switch to the vibration occurrence time mode when such a predetermined condition as to decrease the stability of the shovel body is satisfied. Specifically, as described above, the acceleration and deceleration characteristic control part 300 of FIG. 3 and the vibration predicting part 310 of FIG. 9 may determine that vibration is likely to occur in the shovel body and switch to the vibration occurrence time mode when the stability of the shovel body is relatively low (for example, the position of the bucket 6 is significantly distant from the shovel body or the direction of the attachment is relatively apart from the travel direction of the lower traveling body 1). Furthermore, the acceleration and deceleration characteristic control part 300 of FIG. 3 and the vibration predicting part 310 of FIG. 9 may sense the occurrence of vibration or predict that the work condition is such that vibration is likely to occur in the shovel body and switch to the vibration occurrence time mode when information on a change in the attitude of the shovel, such as the value of a position, velocity, acceleration or the like or the variation thereof at a reference position or in a reference plane on the shovel, reaches or exceeds a threshold, or reaches or exceeds a threshold a predetermined number of times or more. The reference position or reference plane is specifically set not on the attachment but on the upper turning body 3, where an operator seat (the cabin 10) is present and the operator's operating apparatuses is present. Alternatively, the acceleration and deceleration characteristic control part 300 of FIG. 3 and the vibration predicting part 310 of FIG. 9 may sense or predict the occurrence of vibration based on the computed information of at least one of the stability of the shovel, a slip of the shovel, a lift of the shovel, and the position of the center of gravity of the shovel.

All of the elements 311 through 319 illustrated in FIG. 15 are not necessary, and only one or some of them may be provided.

Furthermore, while it is illustrated that the vibration predicting part 310 of FIG. 9 predicts the occurrence of vibration in the shovel body on the basis of short-term or long-term sensing based on a parameter such as information on a change in the attitude of the shovel, the short-term or long-term sensing technique associated with the occurrence of vibration may be applied to not only vibration prediction but also detection of the actual occurrence of vibration.

Figure 18:
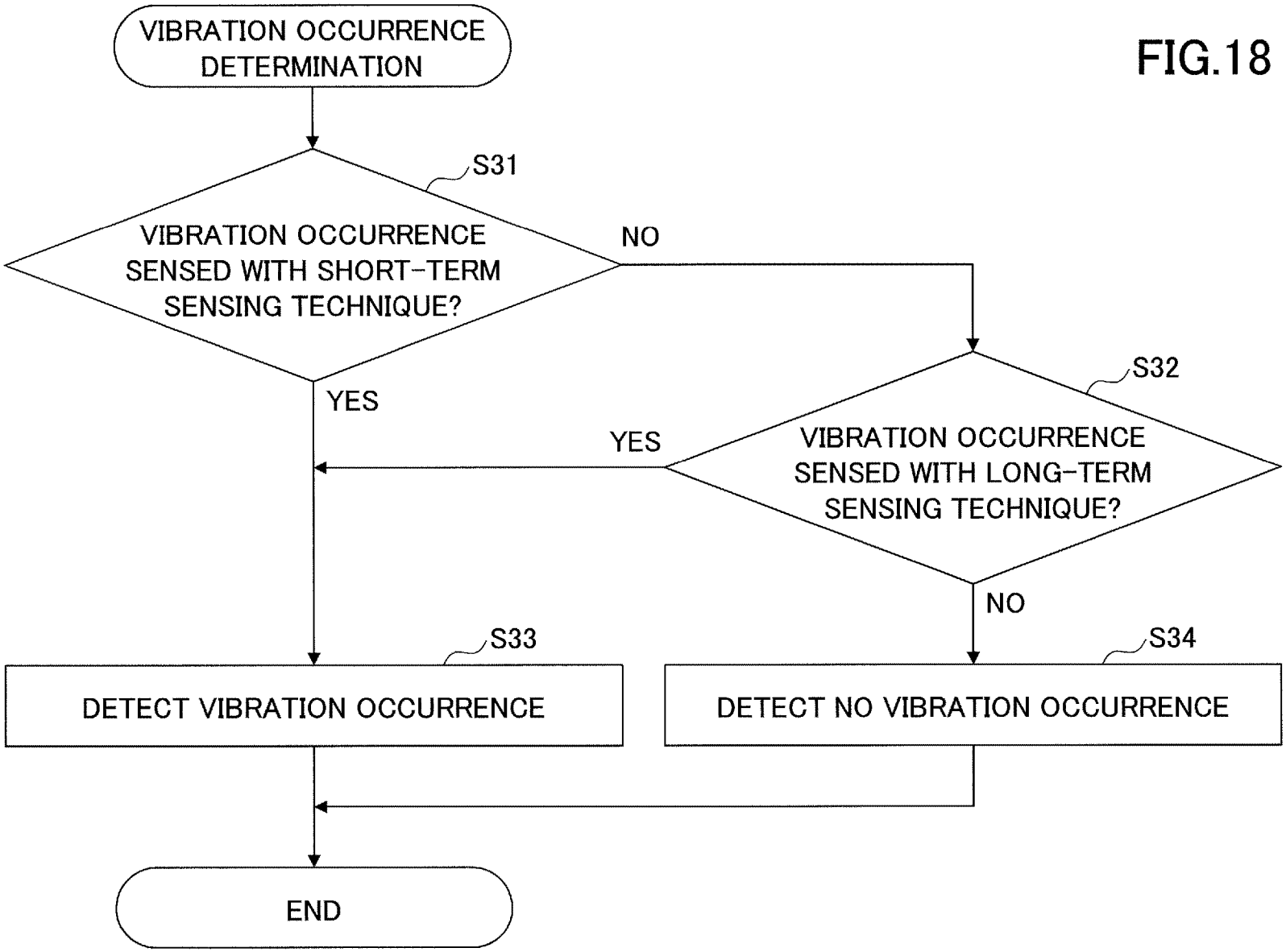
FIG. 18 is a flowchart illustrating an example of the subroutine of step S3 of FIGS. 6 and 14.

FIG. 18 is a flowchart illustrating an example of the subroutine of step S3 of FIGS. 6 and 14. The subroutine of FIG. 18 illustrates an example flow in the case of applying the short-term and the long-term sensing technique associated with the occurrence of vibration to the vibration occurrence determining process of step S3. The flow sequence illustrated in FIG. 18 is executed by the acceleration and deceleration characteristic control part 300.

First, at step S31, it is determined whether the occurrence of vibration is sensed by the short-term sensing technique. If the occurrence of vibration is detected (YES at step S31), step S33 is entered. If no occurrence of vibration is sensed (NO at step S31), step S32 is entered.

At step S32, because no occurrence of vibration is sensed by the short-term sensing technique at step S31, it is determined whether the occurrence of vibration is sensed by the long-term sensing technique. If the occurrence of vibration is detected (YES at step S32), step S33 is entered. If no occurrence of vibration is sensed (NO at step S32), step S34 is entered.

At step S33, because the occurrence of vibration is sensed by the short-term sensing technique at step S31 or the occurrence of vibration is sensed by the long-term sensing technique at step S32, it is determined that the occurrence of vibration is detected, then returning to the main flow to proceed to step S4.

At step S34, because no occurrence of vibration is sensed by the short-term sensing technique at step S31 and no occurrence of vibration is sensed by the long-term sensing technique at step S32, it is determined that no occurrence of vibration is detected, then returning to the main flow to return to step S2.

Figure 19:
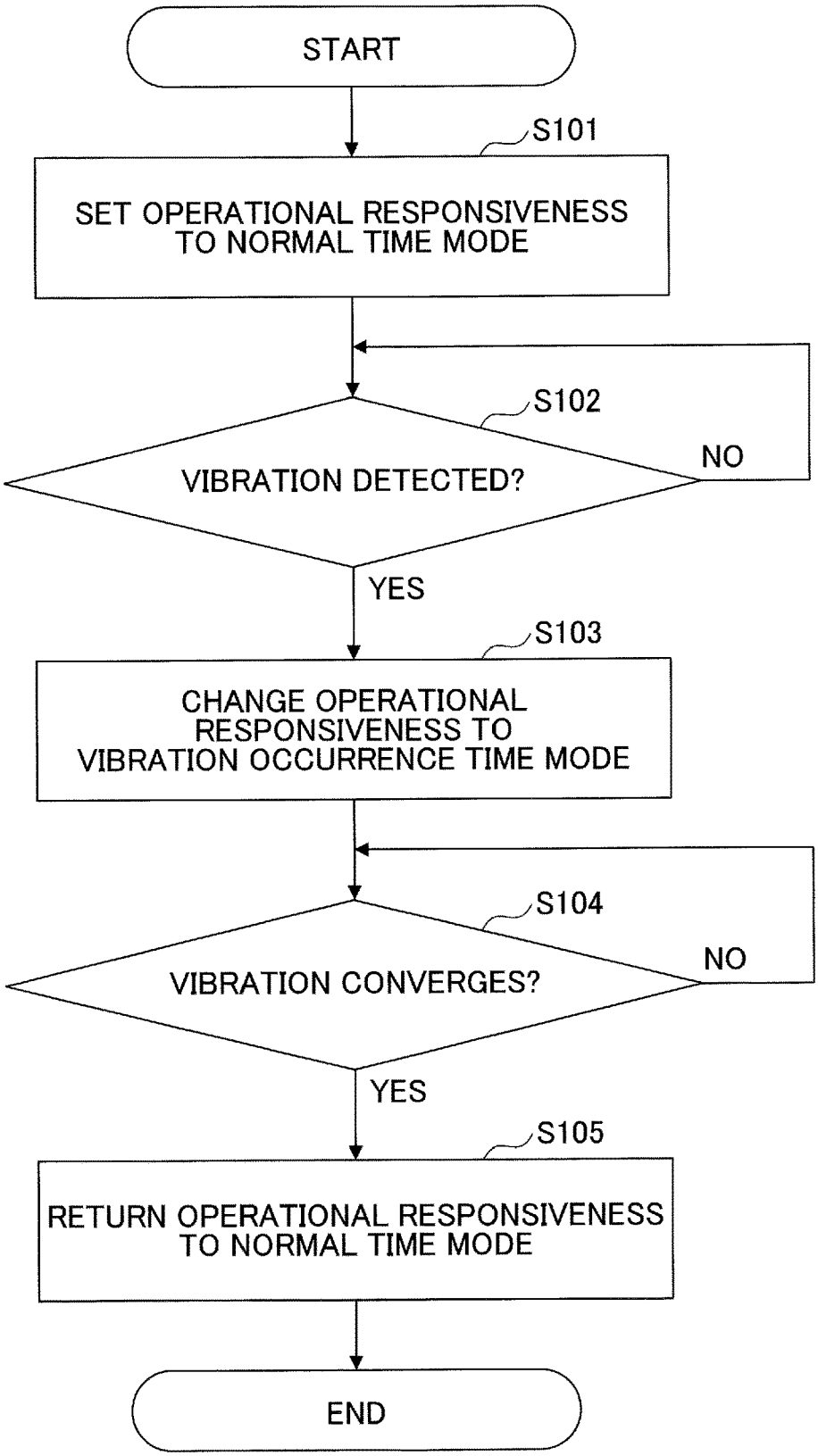
FIG. 19 is a flowchart generalizing the processes of FIG. 6.
Figure 20:
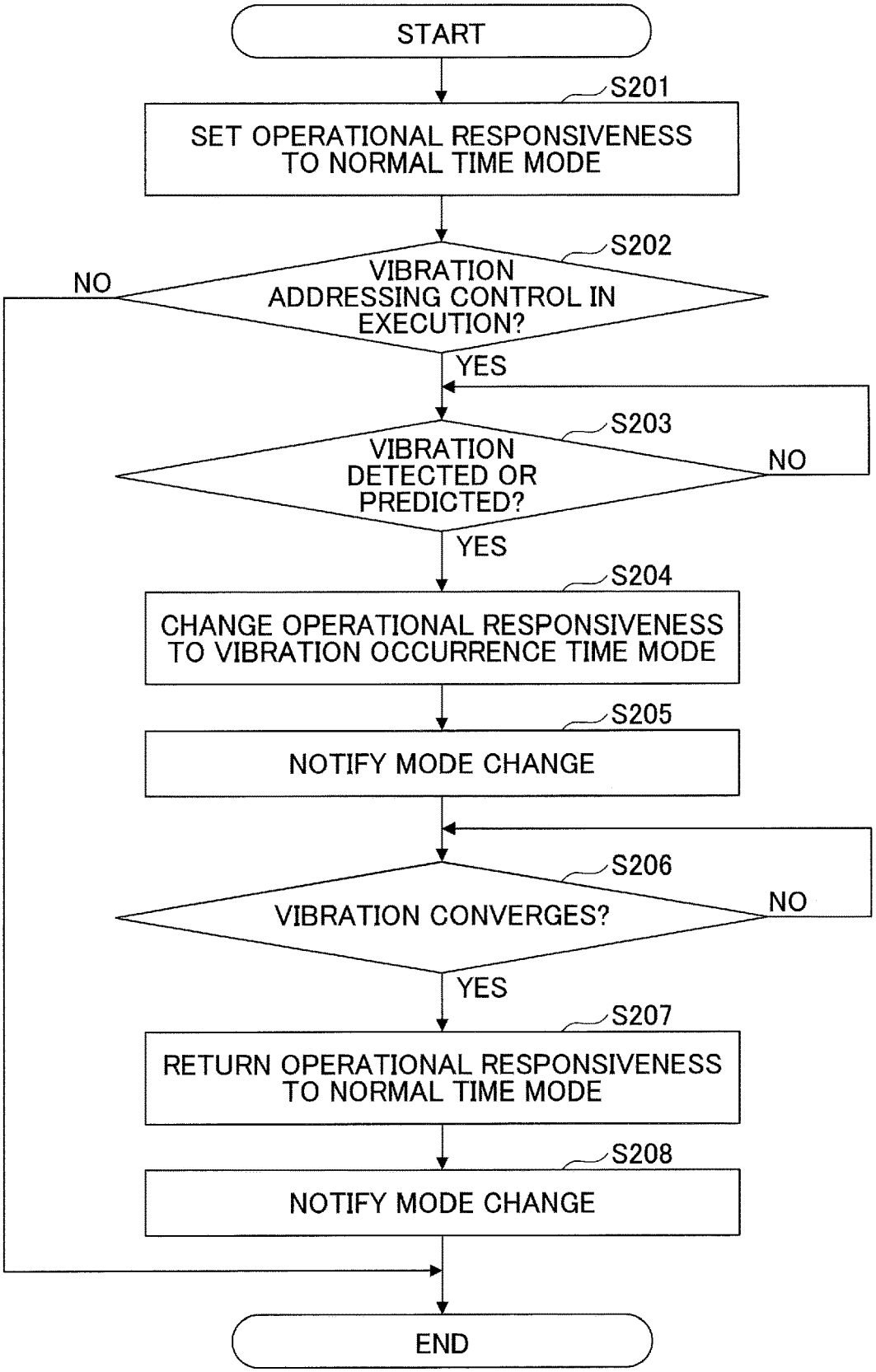
FIG. 20 is a flowchart generalizing the processes of FIG. 14.

When the acceleration and deceleration characteristic control part 300 of FIG. 3 and the vibration predicting part 310 of FIG. 9 include various vibration sensing means other than the body inclination angle as illustrated in FIG. 15, the flowcharts illustrated in FIGS. 6 and 14 may be generalized into FIGS. 19 and 20. FIG. 19 is a flowchart generalizing the processes of FIG. 6.

As illustrated in FIG. 19, at step S101, the operational responsiveness (such as the bleed valve opening characteristic or the control valve opening characteristic) is set to the normal time mode.

At step S102, it is determined whether the occurrence of vibration in the shovel body is detected. The acceleration and deceleration characteristic control part 300 may detect the occurrence of vibration using, for example, one of the elements 311 through 319 illustrated in FIG. 15. If the occurrence of vibration is detected (YES at step S102), step S103 is entered. If no occurrence of vibration is detected (NO at step S102), the operational responsiveness is kept as is in the normal time mode.

At step S103, because the occurrence of vibration in the shovel body is detected at step S102, the operational responsiveness is changed from the normal time mode to the vibration occurrence time mode.

At step S104, it is determined whether the vibration that has occurred in the shovel body has converged. For example, the acceleration and deceleration characteristic control part 300 may detect the convergence of vibration, using one of the elements 311 through 319 illustrated in FIG. 15 the same as at step S102. If no convergence of vibration is detected (NO at step S104), the operational responsiveness is kept in the vibration occurrence time mode until the vibration converges.

At step S105, because the vibration of the shovel body has converged according to the result of the determination of step S104, the operational responsiveness is returned from the vibration occurrence time mode to the normal time mode, and this control flow ends.

FIG. 20 is a flowchart generalizing the processes of FIG. 14. A description of steps S201, S204, S206, and S207, which are equal to steps S101 through S105 of FIG. 19, is omitted.

As illustrated in FIG. 20, at step S202, it is determined whether vibration addressing control (for example, the acceleration and deceleration characteristic control) is in execution. If the vibration addressing control is in execution (YES at step S202), step S203 is entered. If not (NO at step S202), this control flow ends without executing the vibration addressing control.

At step S203, it is determined whether the occurrence of vibration in the shovel body is detected or predicted. The acceleration and deceleration characteristic control part 300 or the vibration predicting part 310 may detect or predict the occurrence of vibration using, for example, one of the elements 311 through 319 illustrated in FIG. 15. If the occurrence of vibration is detected or predicted (YES at step S203), step S204 is entered. If no occurrence of vibration is detected or predicted (NO at step S203), the operational responsiveness is kept as is in the normal time mode.

At step S205, the shovel operator is notified that the operational responsiveness is changed from the normal time mode to the vibration occurrence time mode at step S204. When the process of step S205 is completed, step S206 is entered.

At step S208, the shovel operator is notified that the operational responsiveness is returned from the vibration occurrence time mode to the normal time mode at step S207. When the process of step S208 is completed, this control flow ends.

According to the above-described embodiments, hydraulic operating apparatuses such as the arm operating lever 26A and the boom operating lever 26B are illustrated as examples of operating apparatuses, while electric operating apparatuses may also be used. When the arm operating lever 26A and the boom operating lever 26B of the above-described embodiments are electric levers, the amount of hydraulic oil supplied to the proportional valves 31L1 and 31R1 of FIG. 3 or the reducing valves 33L1, 33R1, 33L2, and 33R2 of FIG. 7 may be controlled by, for example, the controller 30 converting the direction of operation and the amount of operation (the amount of tilt in the case of a lever) of the arm operating lever 26A or the boom operating lever 26B into an electric detection value (voltage, electric current or the like) and adjusting the discharge quantity of the pilot pump 15 based on the value. This makes it possible to directly change the pilot characteristic of the bleed valves 177L and 177R of FIG. 3 and the control valves 175L, 175R, 176L, and 176R of FIG. 7. When the operating apparatus is an electric lever, with respect to the adjustment of its responsiveness, the value of an electric detection value corresponding to the amount of operation may also be directly adjusted. This makes it possible to realize the same adjustment as in the case of being based on a pilot pressure.

The above-described embodiments illustrate that the acceleration and deceleration characteristic is switched from the normal time mode to the vibration occurrence time mode when vibration is detected, while the acceleration and deceleration characteristic may be selected from among multiple levels according to the degree of vibration.

The above-described embodiments illustrate performing such control as to reduce the acceleration and deceleration characteristic of a hydraulic actuator when the vibration of the shovel body is detected, while other characteristics may be changed if the responsiveness of a hydraulic actuator to the operation of an operating apparatus can be reduced so that the amplification of the vibration of the shovel body due to hand hunting can be controlled.

What is claimed is:

1. A shovel comprising:

a hydraulic actuator;

an operating apparatus used to operate the hydraulic actuator;

a hydraulic pump configured to supply hydraulic oil to, the hydraulic actuator;

an engine configured to drive the hydraulic pump;

an obtaining device configured to obtain information concerning a vibration of a body of the shovel; and a hardware processor configured to detect an occurrence of the vibration of the body of the shovel based on an output of the obtaining device and perform such control as to reduce responsiveness of the hydraulic actuator to an operation of the operating apparatus in response to detecting the occurrence of the vibration of the body of the shovel, wherein the hardware processor is configured to perform at least one of: such control as to lower an acceleration and deceleration characteristic of the hydraulic actuator with respect to the operation of the operating apparatus; reducing a rotational speed of the engine to reduce a pump flow rate of the hydraulic pump; and controlling a tilt angle of the hydraulic actuator to reduce the pump flow rate of the hydraulic pump, in response to detecting the occurrence of the vibration of the body of the shovel.

2. The shovel as claimed in claim 1, wherein the hardware processor is configured to sense the vibration of the body of the shovel based on information on a change in an attitude of the shovel obtained by the obtaining device.

3. The shovel as claimed in claim 2, wherein the information on the change in the attitude of the shovel is obtained with at least one of a tilt sensor, a gyroscope, an inertial measurement unit sensor, a global positioning system device, and an image capturing device.

4. The shovel as claimed in claim 1, wherein the hardware processor is configured to sense the vibration based on information on at least one of, a slip of the shovel, a lift of the shovel, and a position of a center of gravity of the shovel, the information being computed from the output of the obtaining device.

5. The shovel as claimed in claim 1, further comprising:

a lower traveling body;

an upper turning body turnably mounted on the lower traveling body;

and a control valve configured to control a flow of the hydraulic oil from the hydraulic pump to the hydraulic actuator, wherein the hardware processor is configured to control the responsiveness by changing a pilot pressure acting on the control valve in a case of performing such control as to lower an acceleration and deceleration characteristic of the hydraulic actuator with respect to the operation of the operating apparatus.

6. The shovel as claimed in claim 5, wherein the operating apparatus is an electric lever, and the hardware processor is configured to change the pilot pressure according to a direction of operation and an amount of operation of the electric lever.

7. A shovel comprising:

a hydraulic actuator;

an operating apparatus used to operate the hydraulic actuator;

an obtaining device configured to obtain information concerning a vibration of a body of the shovel; and a hardware processor configured to detect an occurrence of the vibration of the body of the shovel based on an output of the obtaining device and perform such control as to reduce responsiveness of the hydraulic actuator to an operation of the operating apparatus in response to detecting the occurrence of the vibration of the body of the shovel, and select the responsiveness of the hydraulic actuator to the operation of the operating apparatus from among multiple levels according to a degree of an occurring vibration in response to detecting the occurrence of the vibration of the body of the shovel.

8. A shovel comprising:

a hydraulic actuator;

an operating apparatus used to operate the hydraulic actuator;

an obtaining device configured to obtain information concerning a vibration of a body of the shovel;

a hardware processor configured to perform such control as to reduce responsiveness of the hydraulic actuator to an operation of the operating apparatus when the body of the shovel is vibrating or the vibration is likely to occur in the body of the shovel, based on an output of the obtaining device;

a lower traveling body;

an upper turning body turnably mounted on the lower traveling body;

a hydraulic pump mounted on the upper turning body; and a bleed valve configured to control a flow rate of a portion of hydraulic oil discharged by the hydraulic pump, the portion flowing to a hydraulic oil tank without going through the hydraulic actuator, wherein the hardware processor is configured to control the responsiveness by changing an opening area of the bleed valve.

9. The shovel as claimed in claim 8, wherein the hardware processor is configured to determine that the vibration is likely to occur in the body of the shovel when such a predetermined condition as to decrease stability of the body of the shovel is satisfied.

10. The shovel as claimed in claim 8, further comprising:

an engine configured to drive the hydraulic pump, wherein the hydraulic pump is configured to supply the hydraulic oil to the hydraulic actuator; and the hardware processor is further configured to perform at least one of reducing a rotational speed of the engine to reduce a pump flow rate of the hydraulic pump and controlling a tilt angle of the hydraulic actuator to reduce the pump flow rate of the hydraulic pump, when the body of the shovel is vibrating or the vibration is likely to occur in the body of the shovel.

11. The shovel as claimed in claim 8, wherein the hardware processor is configured to select the responsiveness of the hydraulic actuator to the operation of the operating apparatus from among multiple levels according to a degree of an occurring vibration or the vibration that is likely to occur, when the body of the shovel is vibrating or the vibration is likely to occur in the body of the shovel.

12. The shovel as claimed in claim 8, wherein the hardware processor is configured to sense the vibration of the body of the shovel based on information on a change in an attitude of the shovel obtained by the obtaining device.

13. The shovel as claimed in claim 12, wherein the information on the change in the attitude of the shovel is obtained with at least one of a tilt sensor, a gyroscope, an inertial measurement unit sensor, a global positioning system device, and an image capturing device.

14. The shovel as claimed in claim 8, wherein the hardware processor is configured to sense the vibration based on information on at least one of stability of the shovel, a slip of the shovel, a lift of the shovel, and a position of a center of gravity of the shovel, the information being computed from the output of the obtaining device.

15. The shovel as claimed in claim 8, wherein the operating apparatus is an electric lever, and the hardware processor is configured to change the opening area of the bleed valve according to a direction of operation and an amount of operation of the electric lever.

16. The shovel as claimed in claim 8, wherein the hardware processor is configured to determine whether a work condition is such that the vibration is likely to occur in the body of the shovel, based on a value of a position, a velocity, an acceleration, or a variation thereof at a reference position or in a reference plane on the shovel obtained by the obtaining device, and to reduce the responsiveness of the hydraulic actuator to the operation of the operating apparatus in advance in response to determining that the work, condition is such that the vibration is likely to occur in the body of the shovel.

17. The shovel as claimed in claim 16, wherein the hardware processor is configured to determine that the work condition is such that the vibration is likely to occur in the body of the shovel when the value of the position, the velocity, the acceleration, or the variation thereof at the reference position or in the reference plane on the shovel reaches a threshold a predetermined number of times during a predetermined period.

18. The shovel as claimed in claim 16, wherein the hardware processor is configured to determine that the work condition is such that the vibration is likely to occur in the body of the shovel in response to sensing, a first predetermined number of times during a first predetermined period, that the value of the position, the velocity, the acceleration, or the variation thereof at the reference position or in the reference plane on the shovel reaches a threshold a second predetermined number of times during a second predetermined period shorter than the first predetermined period.

* * * * *